US007896331B2

(12) United States Patent
Sasahara et al.

(10) Patent No.: US 7,896,331 B2
(45) Date of Patent: Mar. 1, 2011

(54) METHOD OF TEARING OFF STAPLE AND SHEET POST-PROCESSING APPARATUS

(75) Inventors: Katsuya Sasahara, Izu (JP); Yoshiaki Sugizaki, Sunto-gun (JP); Katsuhiko Tsuchiya, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 427 days.

(21) Appl. No.: 12/061,066

(22) Filed: Apr. 2, 2008

(65) Prior Publication Data

US 2008/0308991 A1 Dec. 18, 2008

Related U.S. Application Data

(60) Provisional application No. 60/943,598, filed on Jun. 13, 2007, provisional application No. 60/943,599, filed on Jun. 13, 2007, provisional application No. 60/943,601, filed on Jun. 13, 2007, provisional application No. 60/943,602, filed on Jun. 13, 2007.

(51) Int. Cl.
*B65H 37/04* (2006.01)

(52) U.S. Cl. ..... 270/58.08; 270/37; 270/58.07; 270/58.12; 270/58.17

(58) Field of Classification Search ..... 270/32, 270/37, 45, 51, 52.18, 58.07, 58.08, 58.12, 270/58.16, 58.17, 58.27
See application file for complete search history.

(56) References Cited

U.S. PATENT DOCUMENTS 5,263,697 A * 11/1993 Yamazaki et al. ..... 270/58.08
6,171,225 B1 * 1/2001 Nonoyama et al. ..... 493/16
6,733,006 B2 * 5/2004 Kobayashi et al. ..... 270/37
6,733,007 B2 * 5/2004 Sekiyama et al. ..... 271/65
7,172,187 B2 2/2007 Terao et al.
2004/0254054 A1 12/2004 Suzuki et al.

FOREIGN PATENT DOCUMENTS

| | | |
|---|---|---|
| JP | 63-180673 | 7/1988 |
| JP | 07-199775 | 8/1995 |
| JP | 2002-012362 | 1/2002 |
| JP | 2002-196653 | 7/2002 |
| JP | 2002-337326 | 11/2002 |
| JP | 2002-355804 | 12/2002 |
| JP | 2003-192214 | 7/2003 |

* cited by examiner

*Primary Examiner*—Leslie A Nicholson, III
(74) *Attorney, Agent, or Firm*—Turocy & Watson, LLP

(57) ABSTRACT

A sheet post-processing apparatus includes a stacking tray on which sheets are stacked, an aligning unit that aligns the sheets stacked on the stacking tray, a stapler that staples the sheets aligned by the aligning unit using two members provided on one surface side and the other surface side in a thickness direction of the sheets, first conveying rollers arranged in a position on an upstream side along a conveying direction after stapling of the sheets and in contact with one end of the sheets and driven to rotate after the stapling by the stapler, and second conveying rollers arranged in a position on a downstream side along the conveying direction of the sheets and in contact with the other end of the sheets and driven to rotate at rotation speed different from that of the first conveying rollers after the stapling by the stapler.

10 Claims, 26 Drawing Sheets

When leading end hangs down, trailing end also hangs down

U-shape phenomenon of sheet

METHOD OF TEARING OFF STAPLE AND SHEET POST-PROCESSING APPARATUS

CROSS-REFERENCE TO RELATED APPLICATIONS

This application claims the benefit of U.S. Provisional Applications No. 60/943,598, filed Jun. 13, 2007; No. 60/943,599, filed Jun. 13, 2007; No. 60/943,601, filed Jun. 13, 2007; and No. 60/943,602, filed Jun. 13, 2007.

BACKGROUND OF THE INVENTION

1. Field of the Invention

The present invention relates to a sheet conveying method for tearing off a staple of a center binding stapler and a sheet post-processing apparatus including conveying means for the sheet conveying method.

2. Description of the Related Art

As it is well known, in recent years, an image forming apparatus having plural functions is spread. A sheet post-processing apparatus including a stapler for stapling sheet ends, a sheet post-processing apparatus including a saddle unit having sheet processing functions such as sheet center folding and sheet center biding, or the like is connected to such an image forming apparatus.

US 2004/0254054A1 discloses a sheet post-processing apparatus having sheet post-processing functions for applying punching (a punch unit), sheet end binding (a stapler), center binding (a center binding stapler), center folding (a center folding blade and a center folding roller), and the like to a plurality of sheets conveyed from an image forming apparatus. Center binding stapling and center folding methods and a mechanism for the methods in a center binding and bookbinding mode of the sheet post-processing apparatus are disclosed. There is also a sheet post-processing apparatus including a stapler for stacking a plurality of sheets conveyed from an image forming apparatus, putting the sheets on standby, and aligning the sheets and center-binding a bundle of the aligned sheets along a center line.

Conventionally, such a center binding stapler capable of performing center binding includes a hammer and an anvil. In such a stapler, after stapling a bundle of sheets, when sheet conveyance is started while a staple used for the stapling cuts into and remains in the anvil, the sheet conveyance is not normally performed and a sheet jam occurs.

In such a case, in order to prevent a sheet jam, there is a technique for forcibly tearing off a staple for stapling cutting into an anvil using a solenoid or the like.

However, in such a case, a solenoid or the like exclusively used for tearing off the staple for stapling is necessary and cost is high. Further, a space for providing the solenoid or the like is necessary.

Therefore, it is an object of the present invention to provide a sheet conveying method that can efficiently and easily tear off a staple for stapling from an anvil and a sheet post-processing apparatus including conveying means for the sheet conveying method.

BRIEF SUMMARY OF THE INVENTION

A sheet post-processing apparatus according to an embodiment of the present invention includes a stacking tray on which sheets are stacked, an aligning unit that aligns the sheets stacked on the stacking tray to a reference position, a center binding stapler that center-bind staples the sheets aligned by the aligning unit using two members provided to be opposed to each other in a thickness direction of the sheets, first conveying rollers arranged in a position for nipping one end of the sheets on an upstream side of the stapler along a conveying direction of the sheets after stapling and driven to rotate, and second conveying rollers arranged in a position for nipping the other end on a downstream side of the stapler and driven to rotate at rotation speed different from that of the first conveying rollers after the stapling by the stapler.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments give below, serve to explain the principles of the invention.

DETAILED DESCRIPTION OF THE INVENTION

Figure 1:
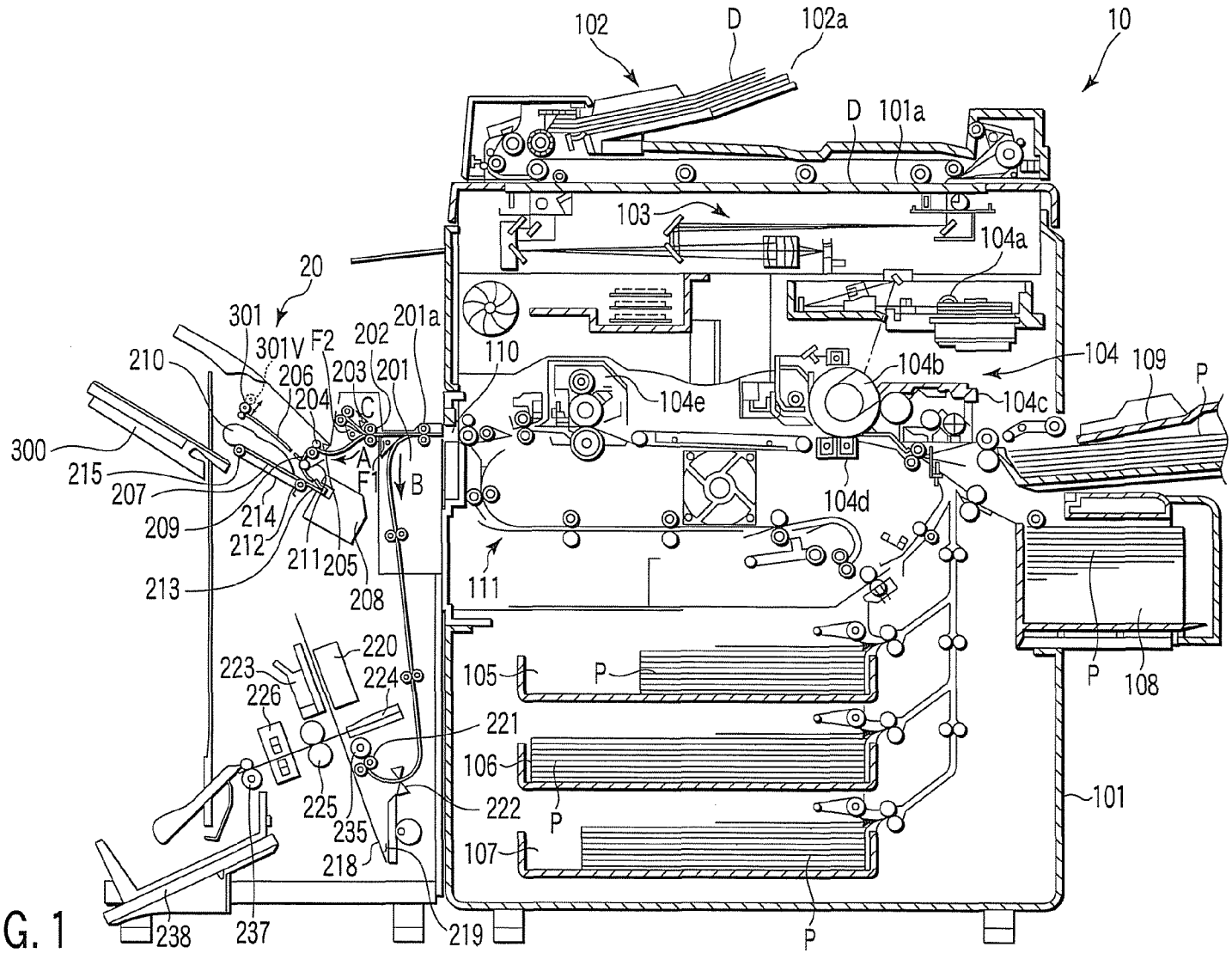
FIG. 1 is a schematic diagram of a sheet post-processing apparatus and an image forming apparatus according to an embodiment of the present invention.

Embodiments of the present invention are explained below with reference to the accompanying drawings. FIG. 1 is a schematic diagram of a sheet post-processing apparatus 20 having a sheet processing function and an image forming apparatus 10 (hereinafter referred to as MFP 10) to which the sheet post-processing apparatus 20 is connected.

First, the MFP 10 is explained. The MFP 10 has a housing 101 that forms an outer shell the MFP 10. A user places originals D on a paper feed tray 102*a* of an automatic document feeder 102 (hereinafter simply referred to as ADF 102), sets presence or absence of stapling, a method of stapling, the number of copies, a sheet size, and the like, and presses a copy start switch. Then, the originals D are scanned and automatically discharged at appropriate timing. A sheet post-processing apparatus 20 described later is attached to a left wall of the housing 101 in the figure.

An image forming unit 104 irradiates a laser beam from a laser device 104*a* on the basis of image information scanned by a scanner unit 103 and forms an electrostatic latent image on a peripheral surface of a photoconductive drum 104*b*. The image forming unit 104 supplies a toner to the electrostatic latent image on the photoconductive drum 104*b* through a developing device 104*c* and visualizes the electrostatic latent image to form a toner image. The image forming unit 104 transfers the toner image onto copy sheets P using a transfer charger 104*d*. The image forming unit 104 supplies the copy sheets P having the toner image transferred thereon to a fixing device 104*e* and causes the fixing device 104*e* to heat and melt the toner image and fix the toner image on the copy sheets P. The image forming unit 104 discharges the copy sheets P to the sheet post-processing apparatus 20 through a discharge port 110. The copy sheets P discharged through the discharge port 110 are sheets that are thereafter processed by the sheet post-processing apparatus 20.

The sheet post-processing apparatus 20 stacks and aligns, in units of the designated number of sheets to be collectively stapled, the copy sheets P having the image formed thereon, i.e., the sheets discharged through the discharge port 110 of the MFP 10 and operates to perform stapling as post-processing. The stapling means process for aligning and stapling one ends of stacked plural sheets.

The sheet post-processing apparatus 20 has a junction box 201 in a position opposed to the discharge port 110 of the MFP 10. The junction box 201 switches, according to a method of stapling or post-processing for plural sheets set as one job setting by the user in the MFP 10 (e.g., setting for one-end stapling or center binding/sheet folding of sheets), a holding position of a flapper F1 provided at a branching point of a conveying path and conveys the plural sheets to a conveying path B and inlet rollers 202. When one-end stapling for the plural sheets is set, the junction box 201 switches the flapper F1 to a conveying path A direction and holds the flapper F1 in the conveying path A direction to convey the plural sheets to the inlet rollers 202 one after another.

Figure 15:
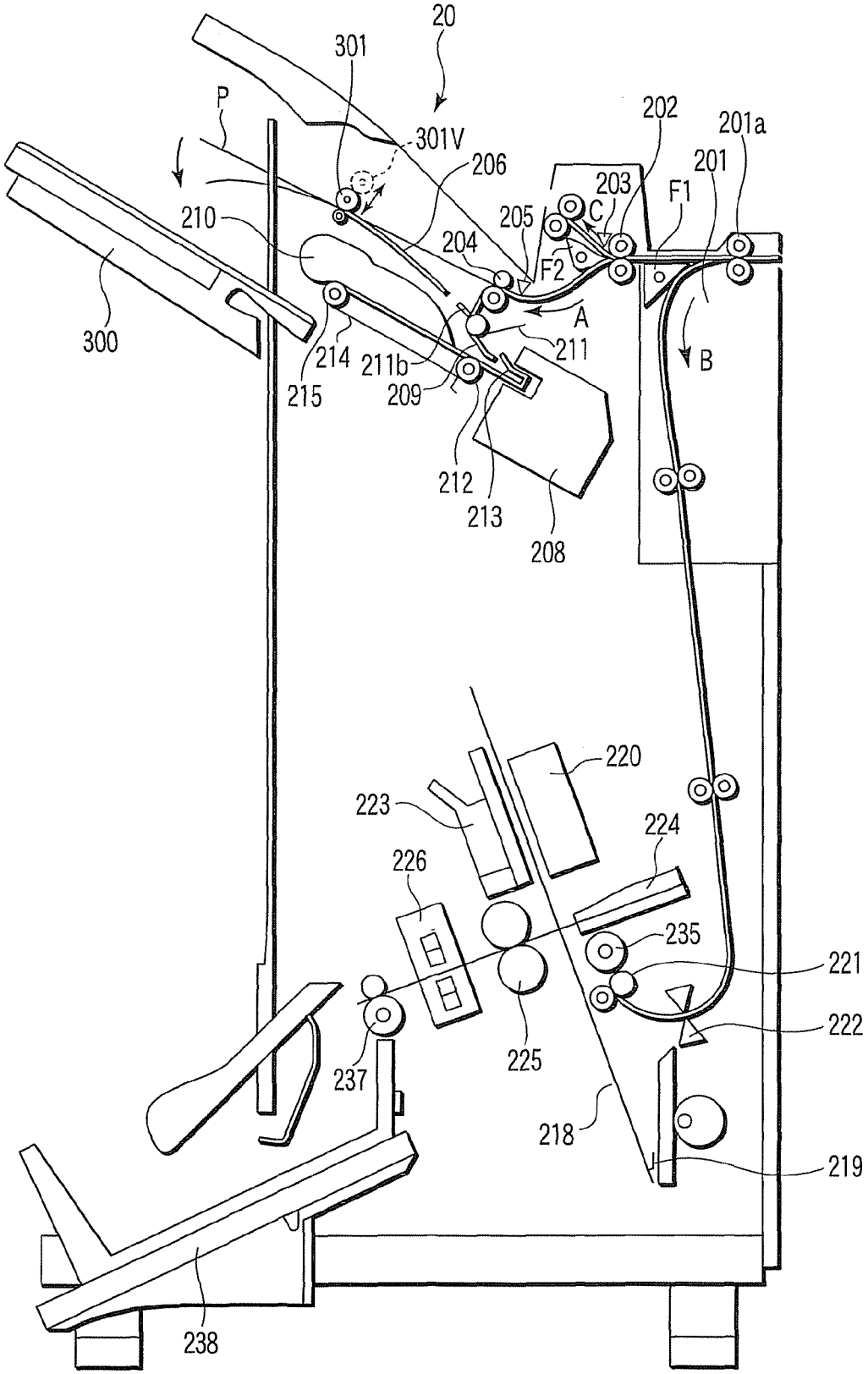
FIG. 15 is a schematic diagram of a sheet-post processing apparatus according to the embodiment.

When center binding and sheet center folding for the plural sheets are set, the junction box 201 switches the flapper F1 to the conveying path B direction and holds the flapper F1 in the conveying path B direction to convey the plural sheets to the conveying path B one after another (see FIG. 15).

Figure 32:
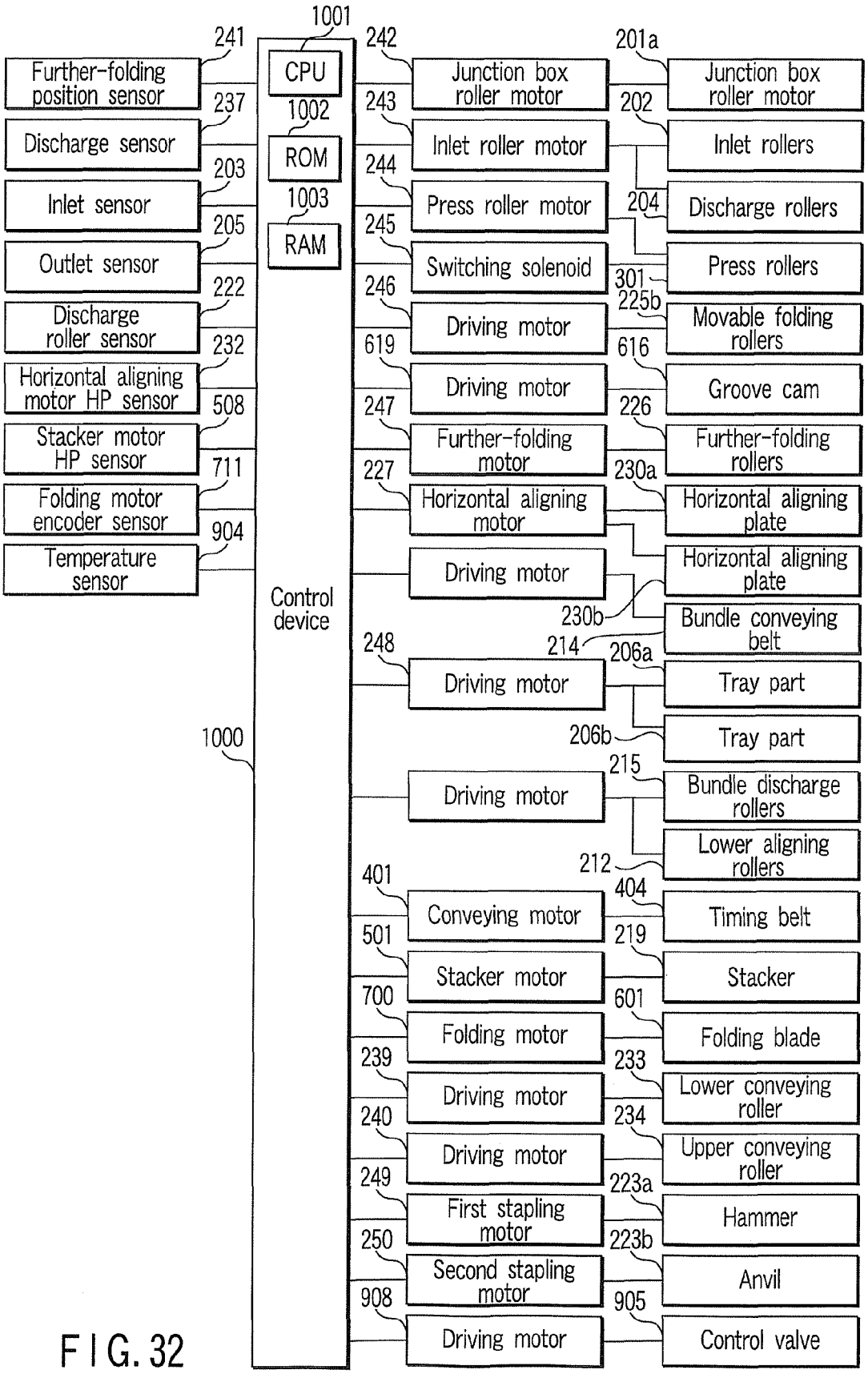
FIG. 32 is a block diagram showing electric control for a sheet post-processing apparatus according to the embodiment.

As shown in FIG. 32, respective sensors and respective motors are connected to a control device 1000. The control device 1000 has a CPU 1001, a ROM 1002, and a RAM 1003. The CPU 1001 controls the respective sensors and the respective motors on the basis of control information recorded in the ROM 1002 in advance. Necessary information is temporarily recorded in the RAM 1003.

<When One-End Stapling is Set for Sheets>

The junction box 201 has junction box rollers 201*a*. The junction box rollers 201*a* are driven by a junction box roller motor 242. The junction box rollers 201*a* convey sheets, which are conveyed from the MFP 10, in the direction of the inlet rollers 202 along a direction in which the flapper F1 is held. The inlet rollers 202 convey the sheets to the conveying path A along a flapper F2 provided at a branching point of the conveying path and switched to and held in the conveying path A direction. An inlet sensor 203 is arranged on a downstream side near the inlet rollers 202. The inlet sensor 203 detects passage of sheets conveyed in a conveying path C direction or the conveying path A direction through the inlet rollers 202. In other words, the inlet sensor 203 detects leading ends and trailing ends of the sheets.

The inlet rollers 202 convey the sheets to discharge rollers 204 through the conveying path A. An outlet sensor 205 is arranged immediately before the discharge rollers 204 in a sheet feeding direction and detects the sheets conveyed through the conveying path A. In other words, the outlet sensor 205 detects passage of leading ends and trailing ends of the sheets in the feeding direction. The discharge rollers 204 convey the sheets, which have passed through the conveying path A, to a waiting tray 206. The discharge rollers 204 are driven by an inlet roller motor 243. In other words, the discharge rollers 204 are driven in association with the inlet rollers 202.

In the sheet post-processing apparatus 20 according to this embodiment, driving motors that drive the inlet rollers 202 and the discharge rollers 204 independently from each other may be provided.

Figure 14:
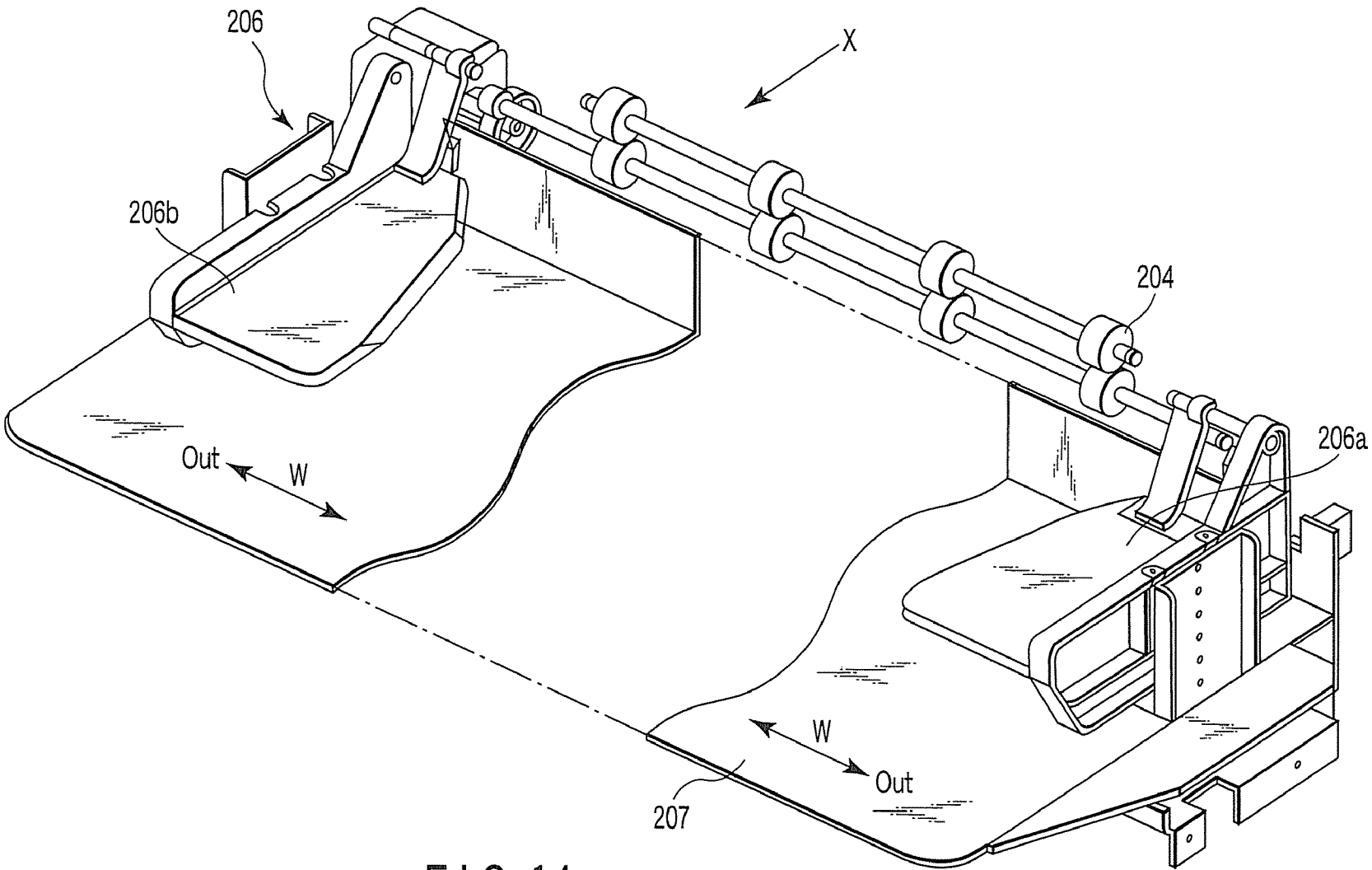
FIG. 14 is a perspective view schematically showing a waiting tray and a processing tray according to the embodiment.

The waiting tray 206 includes, as shown in FIG. 14, a pair of sheet supporting members 206*a* and 206*b* (hereinafter referred to as tray parts) that support a lower surface of sheets.

Until a trailing end of a first sheet P to be put on standby in the waiting tray 206 is discharged from the discharge rollers 204, press rollers 301 can convey a leading end of the sheet P, which has reached a nip of the press rollers 301, to a position where the leading end projects from the waiting tray 206. Depending on the length of the sheet P, the leading end may project to the outside of the sheet post-processing apparatus 20. The press rollers 301 are driven by a press roller motor 244. When a predetermined time elapses after the trailing end of the sheet P is discharged from the discharge rollers 204 and the conveyance of the sheet P is stopped (or simultaneously with the stop of the conveyance), the nip of the press rollers 301 is opened. Then, the sheet P slides with its own weight and is aligned at a rear end in a lower part of the waiting tray 206 and temporarily put on standby therein.

In this embodiment, the discharge rollers 204 (first rollers) arranged on an upstream side of the waiting tray 206 and the press rollers 301 (second rollers) arranged on a downstream side of the waiting tray 206 can be driven independently from each other. Alternatively, driving means that can be driven independently from each other may be provided.

The sheet post-processing apparatus 20 has a waiting tray 206 on which plural sheets conveyed through the conveying path A via the inlet rollers 202 and the discharge rollers 204 are stacked and temporarily put on standby, a processing tray 207 on which sheets dropped by the movement of a pair of tray parts 206*a* and 206*b* of the waiting tray 206 in an outward direction orthogonal to a conveying direction of the sheets are stacked and trailing ends of the sheets for stapling are aligned, and a stapler 208 that staples the aligned trailing ends of the sheets stacked on the processing tray 207.

A sheet guide 209 that guides a dropped sheet and the following sheets to be stacked is provided above the processing tray 207.

The waiting tray 206 and the processing tray 207 are provided to be inclined upward along a sheet feeding direction. In other words, the waiting tray 206 and the processing tray 207 are inclined downward to the trailing ends of the sheets.

When a predetermined number of sheets are stacked on the processing tray 207, in the processing tray 207, horizontal aligning plates 210 horizontally align the sheets. A paddle 211 and lower aligning rollers 212 strike trailing ends of the sheets against trailing end stoppers 213 to vertically align the sheets. When the alignment is completed, the stapler 208 is moved from a home position thereof to a predetermined stapling position (e.g., a sheet corner portion or two-place stapling position) to staple the sheets.

A predetermined processing time is required for the stapling by the stapler 208. Therefore, when the stapler 208 is stapling the sheets on the processing tray 207, it is necessary to put sheets conveyed for stapling next on standby in a place different from the processing tray 207.

In this embodiment, it is explained how stapling time for plural sheets already stacked on the processing tray 207 earlier should be secured. When sheets in prior job setting are being stapled in the processing tray 207, two sheets among plural sheets that should be stapled next are put on standby in the waiting tray 206. In other words, first and second sheets among the sheets conveyed through the conveying path A are stacked and put on standby in the waiting tray 206. After the stapler 208 finishes stapling for the sheets in the prior job setting, a bundle of the two sheets is dropped from the waiting tray 206 to the processing tray 207 by the movement of the pair of tray parts 206*a* and 206*b* in a sheet width direction. Third and subsequent sheets are once stacked on the waiting tray 206 while being reciprocatingly moved between the tray parts 206*a* and 206*b* one by one and, then, dropped to and stacked on the processing tray 207 as described above. Alternatively, while the pair of tray parts 206*a* and 206*b* are kept moved to an outer side in the sheet width direction, the sheets may be directly discharged from the discharge rollers 204 to the processing tray 207 not through the waiting tray 206.

It is possible to reduce a loss of stapling time by increasing the number of sheets stacked on the waiting tray 207 in order to realize an increase in speed of stapling cycles for plural copies.

Figure 2:
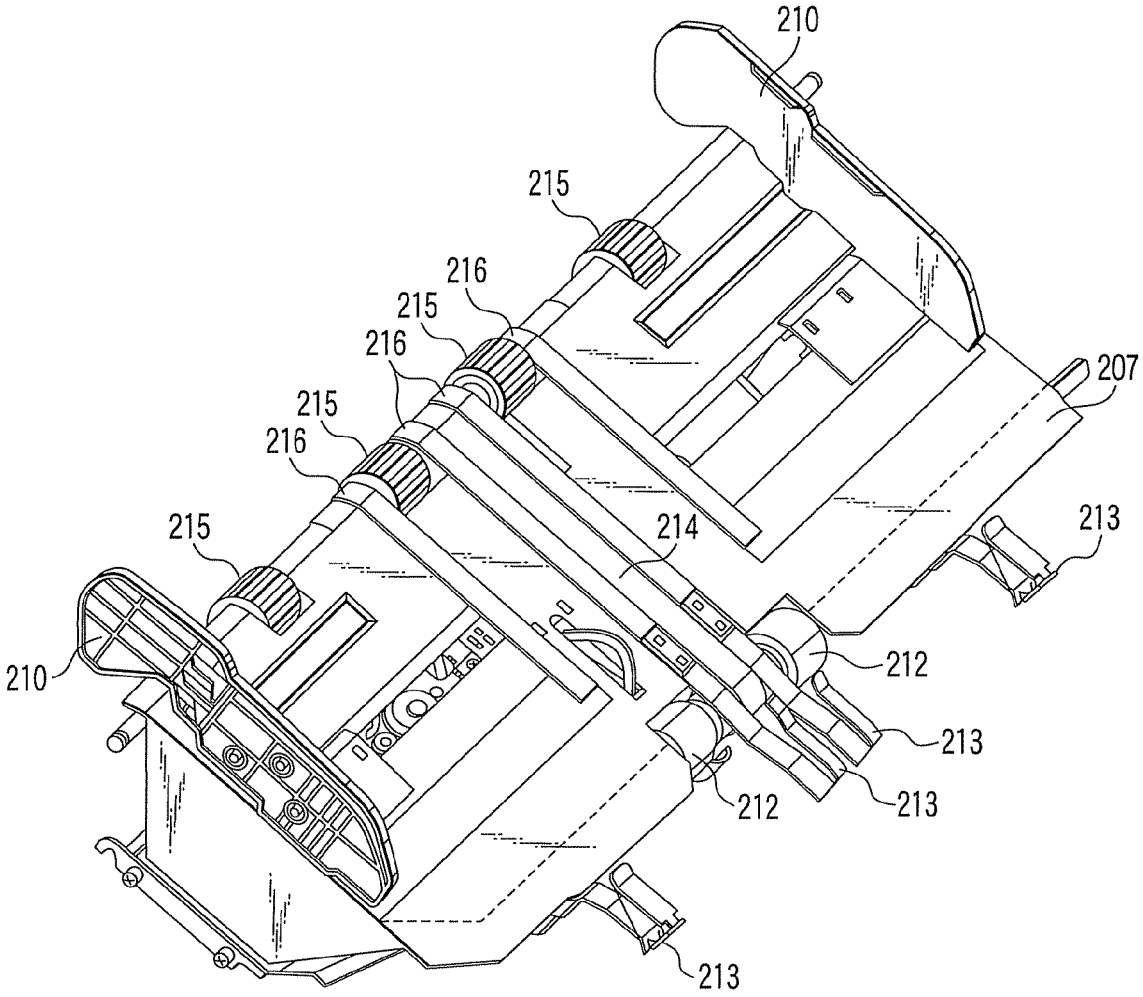
FIG. 2 is a perspective view of a processing tray according to the embodiment.

Alignment of sheets in the processing tray 207 is explained with reference to FIGS. 1 and 2. In the processing tray 207, the horizontal aligning plates 210 are pressed against side ends of the sheets from both sides thereof, the paddle 211 and the lower aligning rollers 212 are driven to strike trailing ends of the sheets against the trailing end stoppers 213 and vertically align the sheets.

The horizontal aligning plates 210, the paddle 211, and the lower aligning rollers 212 align sheets fed one after another on the processing tray 207 as described above. When the number of sheets on the processing tray 207 reaches a predetermined number or more, the sheet guide 209 moves to expand a space between the sheet guide 209 and the processing tray 207. After a last page is aligned, the stapler 208 moves to a stapling position of job setting and staples a bundle of sheets in units of the number of sheets in the job setting.

When the stapler 208 staples the bundle of sheets in units of the number of sheets in the job setting, the stapler 208 once moves to a retracted position. Ejectors 213 push the stapled bundle of sheets, pass the bundle of sheets to a hook of a bundle conveying belt 214, and discharge the bundle of sheets to a stacking tray 300 in cooperation with bundle discharge rollers 215. In the example explained here, the processing tray 207 includes four pushing rods 216 that support discharge of the bundle of sheets.

<When a Sort Mode is Set>

When sheets are conveyed from the MFP 10, the inlet rollers 202 convey the sheets to the discharge rollers 204 through the conveying path A along a direction in which the flapper F2 provided at the branching point of the conveying path is held. The waiting tray 206 temporarily stores the sheets conveyed by the discharge rollers 204. The waiting tray 206 drops and supplies the sheets, which are temporarily stacked on the waiting tray 206, to the processing tray 207 according to the movement of the pair of tray parts 206*a* and 206*b*.

When a stapling mode is set, on the processing tray 207, the paddle 211 and the lower aligning rollers 212 strike trailing ends of the sheets against the trailing end stoppers 213 to vertically align the sheets. The horizontal aligning plates 210 horizontally align the sheets. A bundle of sheets aligned by shifting the horizontal aligning plates 210 in a direction orthogonal to the sheet conveying direction in synchronization with the horizontal alignment of the sheets is sorted.

In this embodiment, a sort amount in a sheet one-end stapling mode is set to a shift amount in a degree for preventing a part or all of staples of the stapler 208 from overlapping.

When the stapler 208 staples the bundle of sheets, the ejectors 213 push out the stapled bundle of sheets, pass the bundle of sheets to the hook of the bundle conveying belt 214, and discharge the bundle of sheets to the stacking tray 300 in cooperation with the bundle discharge rollers 215.

In the case of a sort mode without stapling, the ejectors 213 sort sheets stacked on the processing tray 207 for every small number of sheets (about one to five sheets) and, then, discharge the sheets.

<When a Center Binding Mode is Set for Sheets>

As shown in FIG. 1, a saddle unit 30 including center binding and center folding mechanisms of a sheet post-processing apparatus is located below the entire sheet post-processing apparatus 20. The junction box rollers 201*a* arranged in the position opposed to the sheet discharge port 110 of the MFP 10 receive sheets from the MFP 10 and convey the sheets to the conveying path B along a switching and holding position of the flapper F1.

The saddle unit 30 has a stack tray 218, a stacker 219, a horizontal aligning mechanism 220, stapler discharge rollers 221, a discharge roller sensor 222, staplers 223, a folding blade 224, a folding roller pair 225, further-folding rollers 226, and an assist roller 235.

Sheets conveyed through the conveying path B and discharged from the stapler discharge rollers 221 are stacked and stored on the stack tray 218. The stacker 219 is a hook serving as a reference stopper for aligning trailing ends in a conveying direction of the sheets conveyed to the stack tray 218. The assist roller 235 strikes the sheets conveyed to the stack tray 218 through the conveying path B against the stacker 219 serving as the reference stopper and aligns the sheets. The discharge roller sensor 222 is sheet detecting means provided on the conveying path for detecting timing when the sheets are struck against the stacker 219 serving as the reference stopper and aligned. The horizontal aligning mechanism 220 aligns a bundle of sheets stacked and stored on the stack tray 218 at an end in a direction orthogonal to the conveying direction. In order to apply center binding to the bundle of sheets aligned on the stack tray 218, the staplers 223 as center binding means are provided to hold the bundle of sheets from a sheet thickness direction. The folding blade 224 and the center folding roller pair 225 apply center folding to the bundle of sheets subjected to the center binding by the staplers 223. The further-folding rollers 226 are a folding roller pair that applies further folding to the bundle of sheets center-folded and conveyed by the folding roller pair 225.

Figure 3:
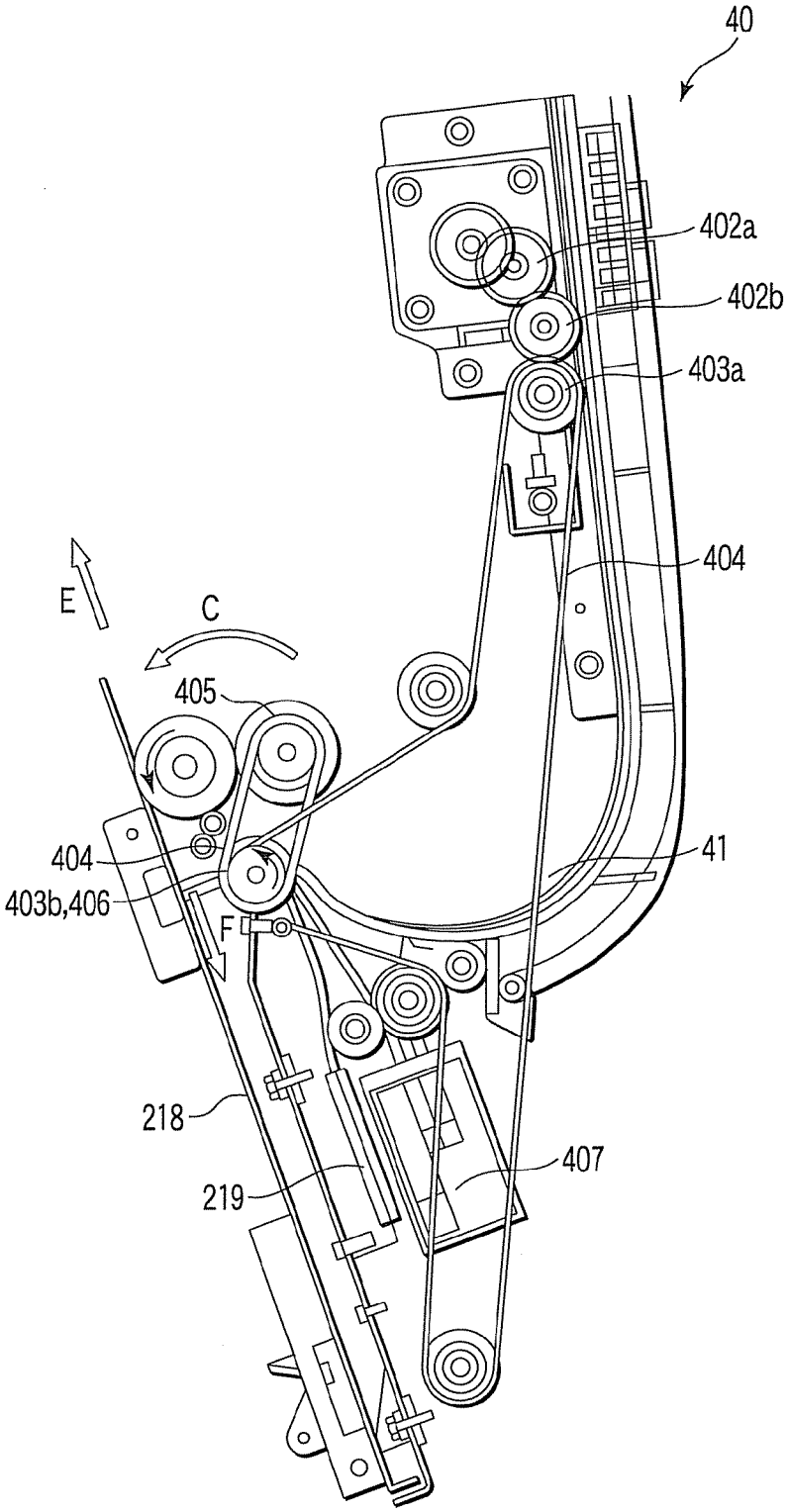
FIG. 3 is a schematic diagram of a saddle unit according to the embodiment.

A conveying unit 40 provided in a conveying path for conveying sheets to the saddle unit 30 is explained with reference to FIG. 3.

The conveying unit 40 that conveys sheets, which are discharged from the MFP 10, to the stack tray 218 through the conveying path B has a conveying motor 401, a gear string 402*a* and 402*b*, a gear and pulley 403*a*, a gear and pulley 403*b*, a timing belt 404, an assist roller 405, a discharge roller 406, and an assist roller solenoid 407.

The conveying motor 401 transmits a driving force to the gear and pulley 402*a* via the gear string 401*a* and 401*b*. The gear and pulley 402*a* is rotated by the conveying motor 401 and drives the respective conveying rollers using the timing belt 404 laid over the gear and pulley 402*a*.

A driving force is transmitted to the assist roller 405 by the timing belt 404 laid over the assist roller 405 via the gear and pulley 403*b*. The assist roller 405 is rotated by the driving of the conveying motor 401.

The assist roller 405 is driven to rotate by the assist roller solenoid 407 provided below the conveying path 40 in an arrow C direction in FIG. 3 with a supporting shaft, to which the gear and pulleys 403*a* and 403*b* are connected, as a fulcrum to come into contact with the stack tray 218.

The assist roller 405 is rotating in an arrow D direction, which is identical with a rotating direction of the discharge roller 406 provided on the supporting shaft. Therefore, when the assist roller solenoid 407 is turned on and sheets conveyed in an arrow E direction in FIG. 3 are in contact with the stack tray 218, sheets discharged onto the stack tray 218 are conveyed in an arrow F direction, which is a return conveying direction, struck against the stacker 219 serving as the reference stopper and aligned.

Figure 4:
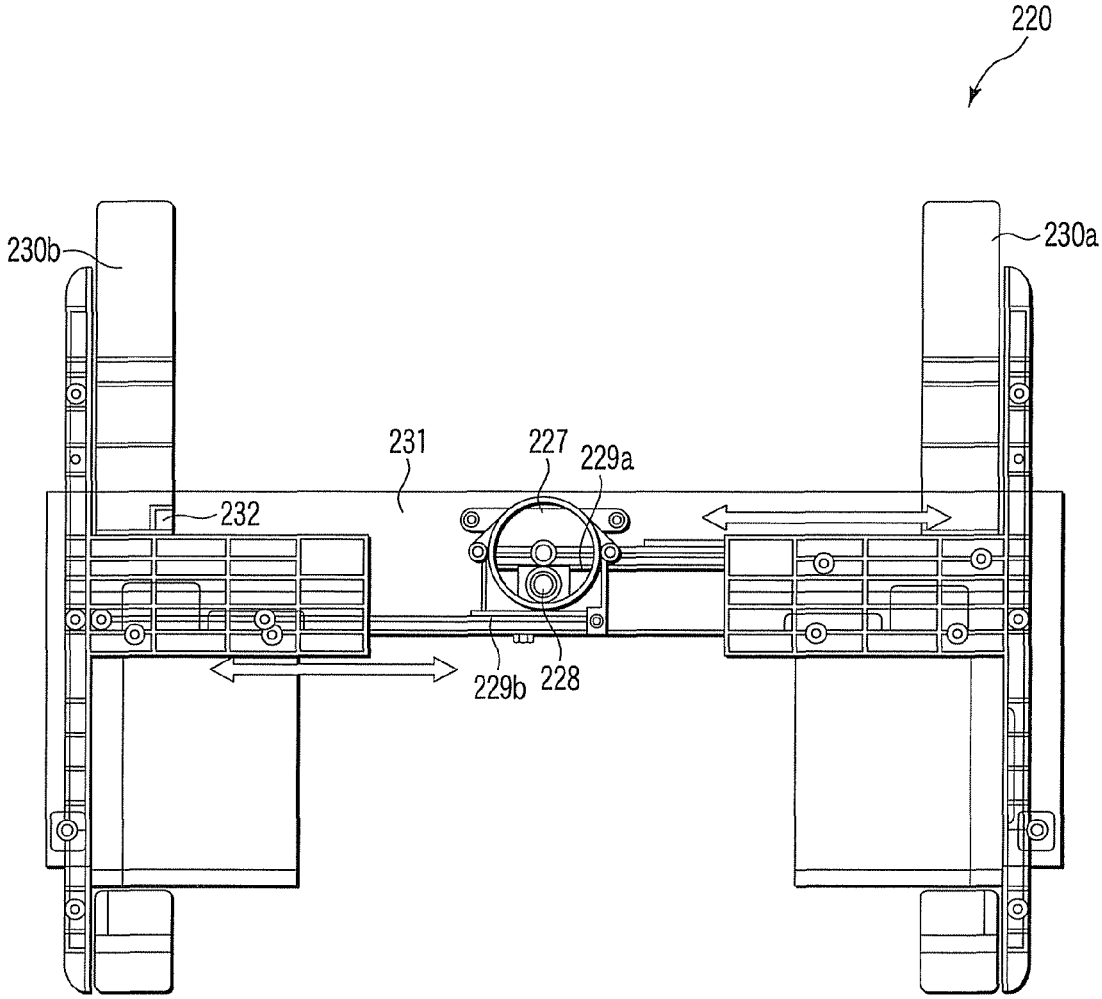
FIG. 4 is a schematic diagram of a horizontal aligning unit according to the embodiment.

The horizontal aligning unit 220 provided in the saddle unit 30 is explained with reference to FIG. 4.

The horizontal aligning unit 220 aligns an end in a conveying direction of a bundle of sheets on the stack tray 218. The horizontal aligning unit 220 includes a horizontal alignment driving unit including a horizontal aligning motor 227 as a stepping motor, a gear 228, and racks 229*a* and 229*b*, horizontal aligning plates 230*a* and 230*b*, a frame 231 as a supporting frame member that supports the horizontal alignment driving unit and the horizontal aligning plates, and a horizontal aligning motor HP sensor 232.

The gear 228 is rotated by the transmission of a driving force from the horizontal aligning motor 227 as a driving source. The racks 229*a* and 229*b* mesh with the gear 228. The racks 229*a* and 229*b* move in an arrow direction in FIG. 4 according to the rotation of the gear 228. The racks 229*a* and 229*b* are mounted on the horizontal aligning plates 230*a* and 230*b*, respectively. Therefore, according to the movement of the racks 229*a* and 229*b*, the horizontal aligning plates 230*a* and 230*b* move in a direction orthogonal to the sheet conveying direction.

The horizontal aligning motor HP sensor 232 is provided in the frame 231. Therefore, moving positions of the horizontal aligning plates 230*a* and 230*b* are managed by a pulse of the horizontal aligning motor 227 according to detection of the moving positions by the horizontal aligning motor HP sensor 232.

Figure 5:
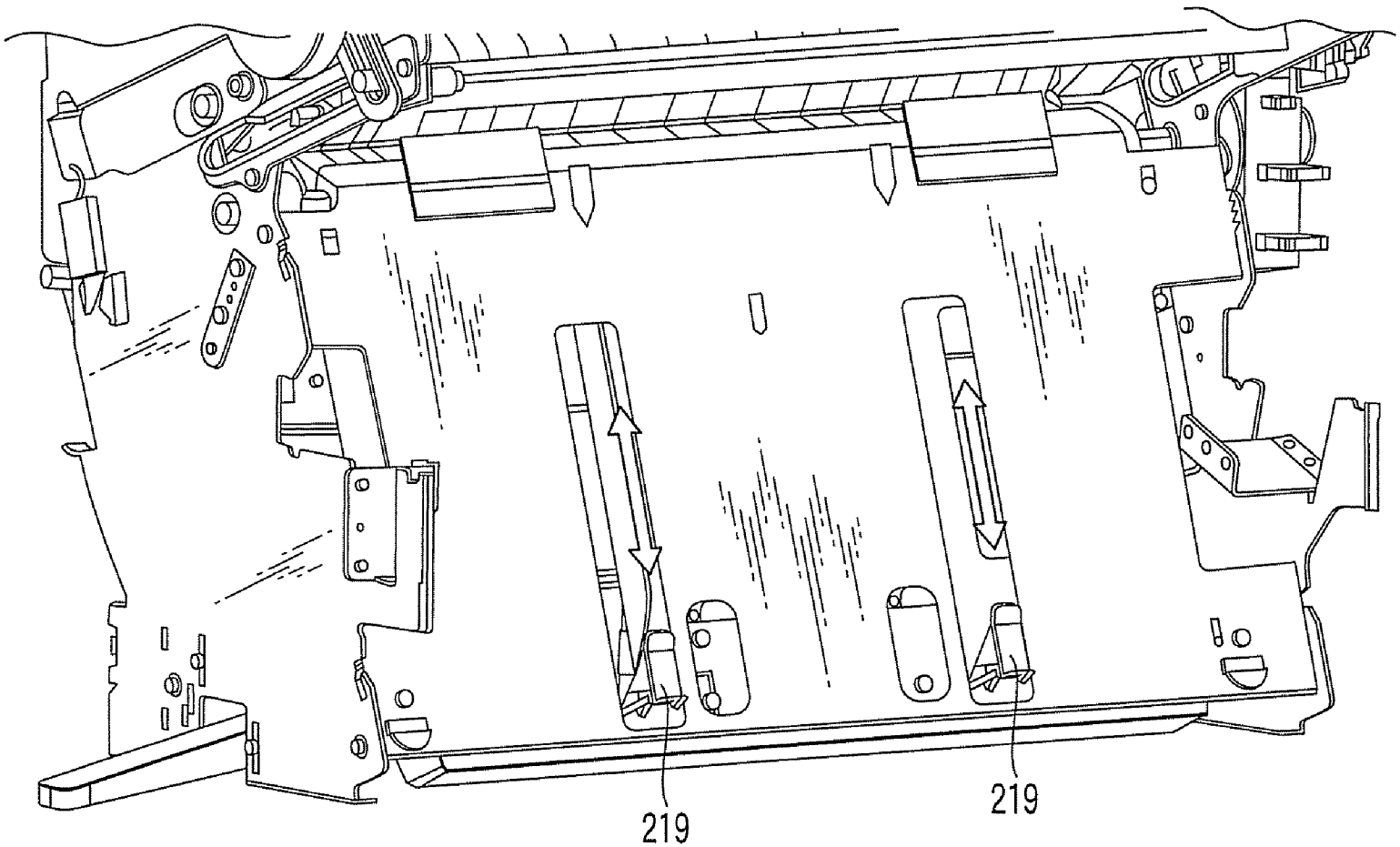
FIG. 5 is a perspective view of a stacker according to the embodiment.
Figure 6:
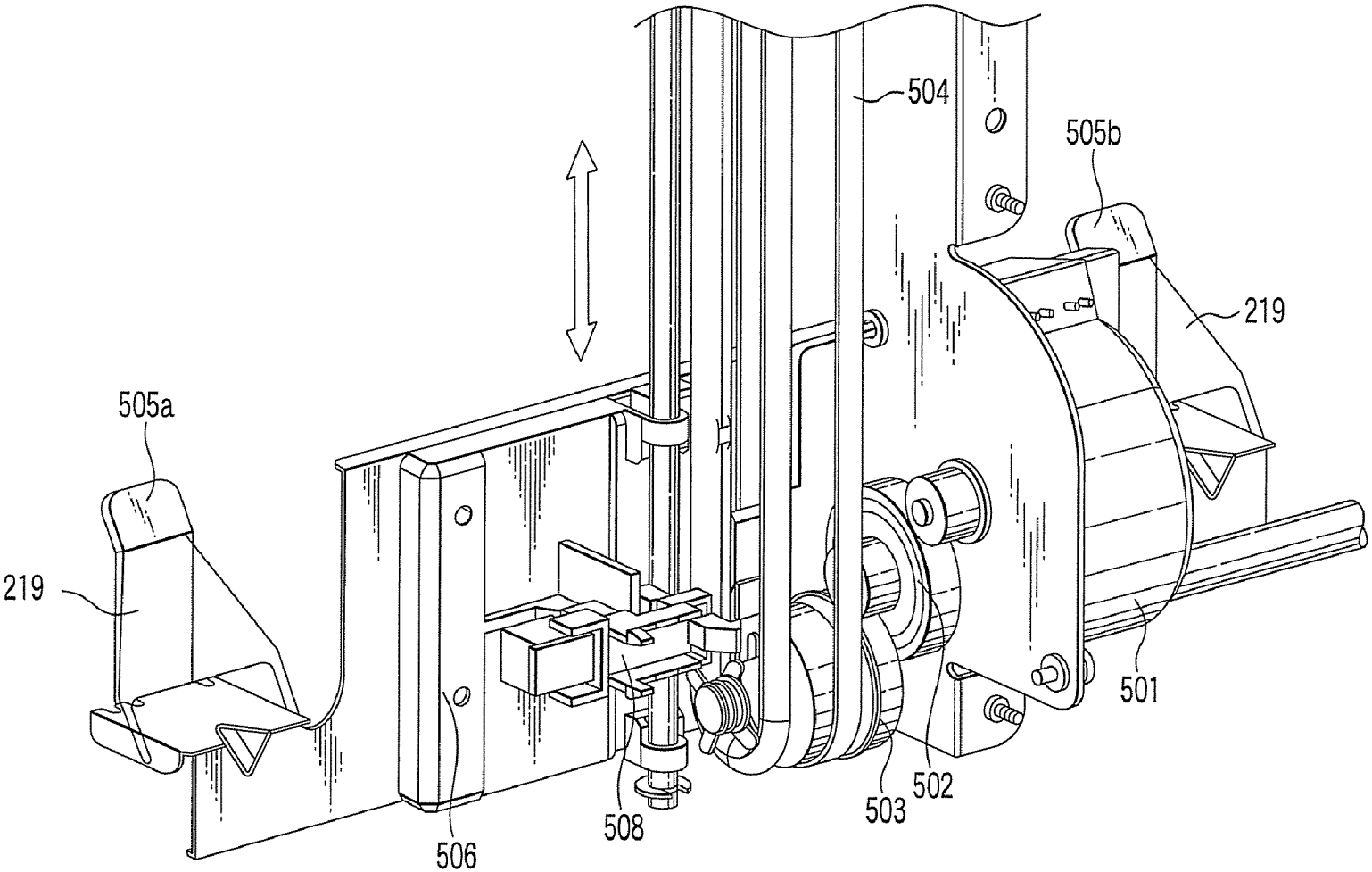
FIG. 6 is a perspective view of the stacker according to the embodiment.

The stacker 219 provided in the saddle unit 30 is explained with reference to FIGS. 5 and 6. The stacker 219 serves as an aligning stopper for a trailing end in the conveying direction of the bundle of sheets on the stack tray 218. The stacker 219 includes a stacker driving unit including a stacker motor 501 as a stepping motor 501, a gear 502, a gear and pulley 503, and a timing belt 504, stacker hooks 505*a* and 505*b*, and a supporting unit 506 that supports the stacker driving unit and the stacker hooks 505*a* and 505*b*.

In the stacker driving unit, the stacker motor 501 as a driving source transmits a driving force to the gear 502 and the gear and pulley 503 and rotates the gear 502 and the gear and pulley 503. The timing belt 504 is laid over the gear and pulley 503. The supporting unit 506 fixedly connected to the timing belt 504 reciprocatingly moves in an arrow direction shown in FIGS. 5 and 6.

The stacker hooks 505*a* and 505*b* are provided in the supporting unit 506. The stacker hooks 505*a* and 505*b* can reciprocatingly move in the arrow direction of the supporting unit 506 shown in FIGS. 5 and 6. Flexible members 507*a* and 507*b* are provided in the stacker hooks 505*a* and 505*b*, respectively. The stacker hooks 505*a* and 505*b* press a bundle of sheets aligned by the stacker hooks 505*a* and 505*b* against a reference surface and hold the bundle of sheets.

A stacker motor HP sensor 508 is provided in the stacker 219. Moving positions of the stacker hooks 505*a* and 505*b* are managed by a pulse of the stacker motor 501 according to detection of the moving positions by the stacker motor HP sensor 508. When a center binding mode is set as a job, as described later, the bundle of sheets on the stack tray 218 is conveyed, by the stacker 219 via the timing belt 503, to a position where a center line of a conveying direction (longitudinal) dimension of the bundle of sheets vertically and horizontally aligned and a stapling position of the staplers 223 coincide with each other (pushed up obliquely left upward in FIG. 1). By means of a driving motor 251, the staplers 223 are moved in the width direction of the sheets and the stapling position thereof is adjusted. The staplers 223 perform stapling in a predetermined position on the center line of the bundle of sheets. In this embodiment, center binding staplers are disposed in two places in a direction orthogonal to the sheet conveying direction. When center folding is performed, a center-bound bundle of sheets is conveyed to a center folding mechanism unit as described later.

Figure 22:
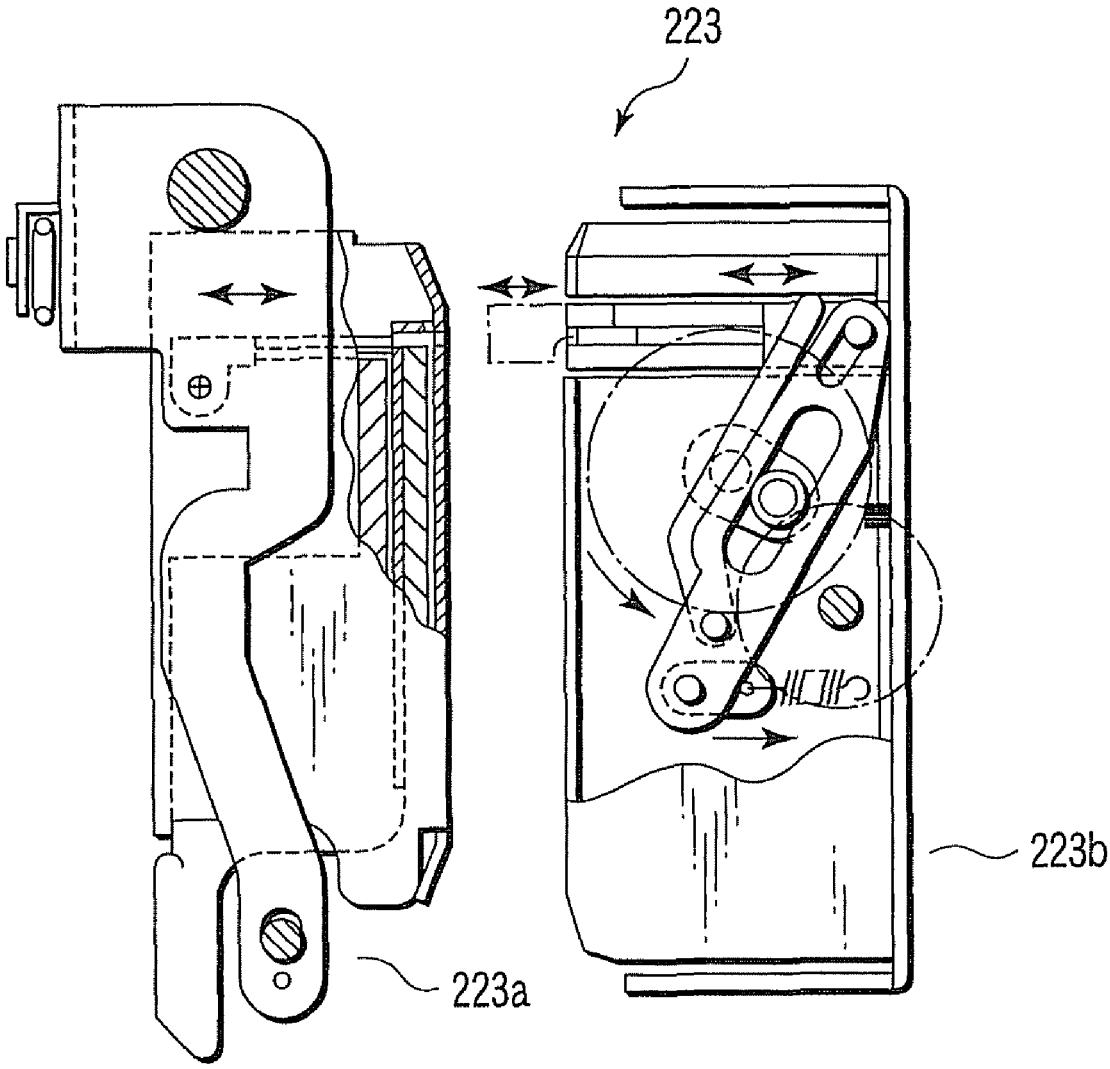
FIG. 22 is a schematic diagram showing an external view of a stapler according to the embodiment.

A hammer 223*a* and an anvil 223*b* are arranged to be opposed to each other in a sheet thickness direction across sheets. The anvil 223*b* is fixed and the hammer 223*a* moves to the anvil 223*b* in a direction orthogonal to a printing surface of the sheets. As shown in FIG. 22, the hammer 223*a* drives a staple for center-binding the sheets into the anvil 223*b*. A distal end of the staple driven by the hammer 223*a* is bent by the fixed anvil 223*b* and the center binding for the sheets is completed.

Figure 7:
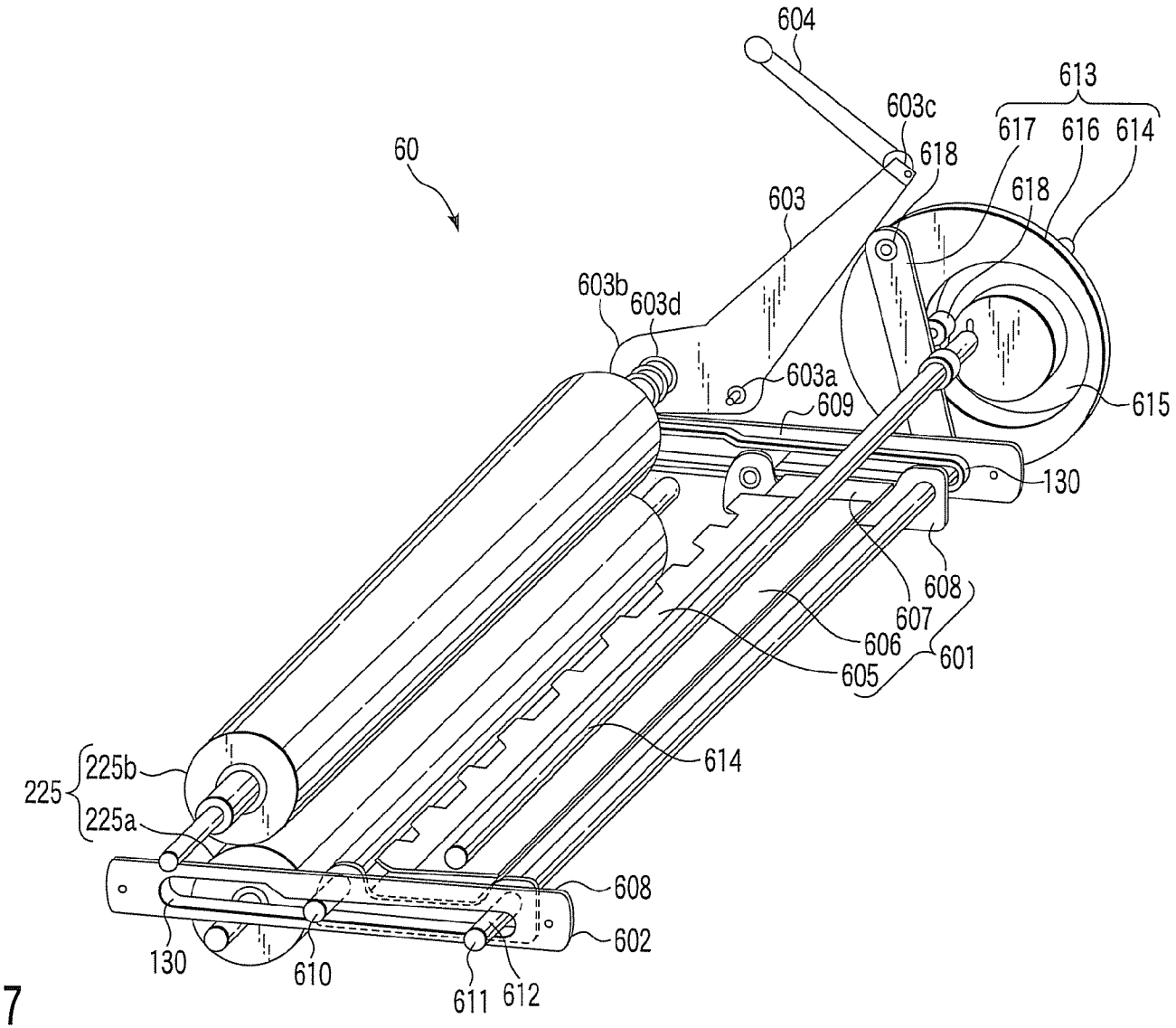
FIG. 7 is a perspective view of a folding mechanism unit according to the embodiment.

A center folding mechanism unit 60 provided in the saddle unit 30 is explained in detail with reference to FIG. 7. The center folding mechanism unit 60 has the folding roller pair 225 shown in FIG. 1 and also has a bundle discharge roller pair 236 that rotates in association with the folding roller pair 225, a folding blade 601, and a guide member (regulating means) 602.

The folding roller pair 225 folds a bundle of plural sheets or a center-folded bundle of sheets in two along a center line of the sheets. The bundle of sheets is conveyed to a position where a blade section 605 of the folding blade 601 comes into contact with the center line of the bundle of sheets and center-folded. The folding blade 601 is a pushing member that pushes the bundle of sheets into a nip portion of the folding roller pair 225. The guide member 602 holds the folding blade 601 slidably to the folding roller pair 225 and, before the bundle of sheets is pushed into the nip portion of the roller pair 225, regulates movement in a direction crossing a moving direction of the folding blade 601.

The folding roller pair 225 includes a fixed folding roller 225*a* and a movable folding roller 225*b*. The fixed folding roller 225*a* is rotatably fixed to and arranged in a not-shown apparatus frame. The movable folding roller 225*b* is rotatably supported at a first arm end 603*b* of an arm 603 rotatably supported around an arm fulcrum section 603*a* in the not-shown apparatus frame. The movable folding roller 225*b* can move in a direction orthogonal to the moving direction of the folding blade 601 and come into contact with and separate from the fixed folding roller 225*a*.

A spring 604 is attached to a second arm end 603*c* of the arm 603. The movable folding roller 225*b* is urged by the arm 603 rotated around the fulcrum 603*a* and moves. The movable folding roller 225*b* comes into press contact with the fixed folding roller 225*a* and forms a nip portion. An arm supporting hole 603*d* that allows the movable folding roller 225*b* to linearly move without drawing an arc when the arm 603 rotates is provided at the first arm end 603*b*.

The fixed folding roller 225*a* and the movable folding roller 225*b* are rotated by the driving motor 246. The folding blade 601 has the blade section 605, a first holding member 606, a second holding member 607, and side plates 608.

The blade section 605 pushes the bundle of sheets and presses the bundle of sheets against the folding roller pair 225. The first holding member 606 and the second holding member 607 hold the blade section 605 between the members. The side plates 608 are attached to both ends of the second holding member 110.

A stud 609 and a first projected portion 610 are attached to a front portion of the side plate 608 on the folding roller pair 225 side. A shaft 611 is attached to the front portion of the side plate 608. A second projected portion 612 is provided in the shaft 611. The folding blade 601 is slidably held by the guide member 602 via the first projected portion 610 provided in the stud 609 and the shaft 611. The first projected portion 610 provided in the stud 609 and the shaft 611 are more stable when a space between the first projected portion 610 and the shaft 611 is larger. Therefore, in this embodiment, a position where the first projected portion 610 of the stud 609 is attached is further on the folding roller pair 225 side than a distal end of the blade section 605.

The stud 609 and the shaft 611 as sliding members are not limited to the structure described above. The first projected portion 610 and the second projected portion 612 may be the stud 609 or the shaft 611 or may be rotatable rollers.

The position where the stud 609 is attached to the side plates 608 is not limited to the structure described above. Driving means 613 for sliding the folding blade 601 are provided at both ends of the shaft 611.

The driving means 613 has a cam shaft 614, a groove portion 615, a groove cam 616 rotatable around the cam shaft 614, and a driven member 617.

A roller 618 such as a roller follower serving as a contact is rotatably guided in the groove portion 615 of the groove cam 616. The roller 618 is attached to the driven member 617. A driven member rotating shaft 618 is provided at one end of the driven member 617. The driven member rotating shaft 618 is attached to the not-shown apparatus frame. The groove cam 616 is rotated by a driving motor 619 connected to one end of the cam shaft 614. When the groove cam 616 rotates, the roller 618 is guided along the groove portion 615. As a result, the driven member 617 repeats reciprocating movement like a pendulum around the driven member rotating shaft 618 according to eccentricity of the groove portion 615.

Figure 8:
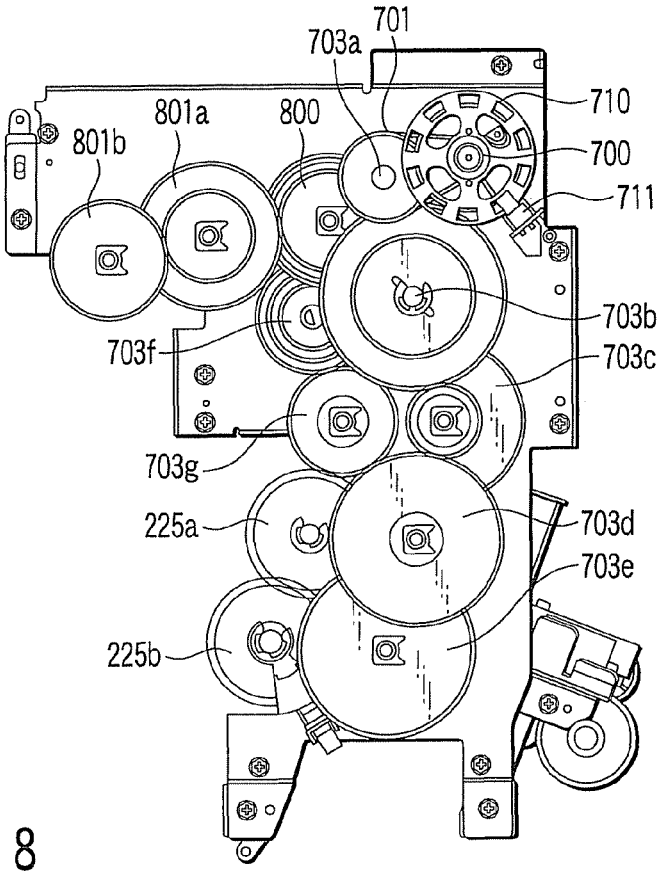
FIG. 8 is a schematic diagram of a driving mechanism for a folding roller pair according to the embodiment.

A driving mechanism for the folding roller pair 225 and the folding blade 601 is explained with reference to FIGS. 8 and 9.

The center folding mechanism unit 60 includes a folding motor 700 as a DC motor, a timing belt 701, a one-way clutch 702, gears 703*a*, 703*b*, 703*c*, 703*d*, 703*e*, 703*f*, 703*g*, 801*a*, 801*b*, and an electromagnetic clutch 800.

First, in a folding roller pair driving unit, with the folding motor 700 as a driving source, the electromagnetic clutch 900 and the gear 703*b* are rotated via the timing belt 701 laid over between the folding motor 700 and the gear 703*a*. The one-way clutch 702 is provided in the gear 703*b*. When the folding motor 700 is rotated in a normal direction, the movable folding roller 225*b* rotates via the gears 703*b*, 703*c*, 703*d*, and 703*e*. On the other hand, when the folding motor 700 is rotated in a reverse direction, the movable folding roller 225*b* rotates via the gears 703*b*, 703*f*, 703*g*, 703*d*, and 703*e*.

Similarly, the folding blade driving unit is driven by the folding motor 700. When the electromagnetic clutch 800 is turned on, a driving force is transmitted to the gears 801*a* and 801*b* and the gear 613 shown in FIG. 7 connected to the gear 801*b* rotates, whereby the folding blade 601 is driven. The number of revolutions of the folding roller pair 225 and a moving position of the folding blade 601 are managed by measurement of an encoder pulse of the folding motor 700 by an encoder actuator 710 and a folding motor encoder sensor 711 connected to the folding motor 700.

Operations of the center binding mechanism and the center folding mechanism are explained with reference to FIGS. 10 to 13. First, a flow in stacking and storing sheets on the stack tray 218 is explained with reference to FIGS. 10 and 11.

Figure 10:
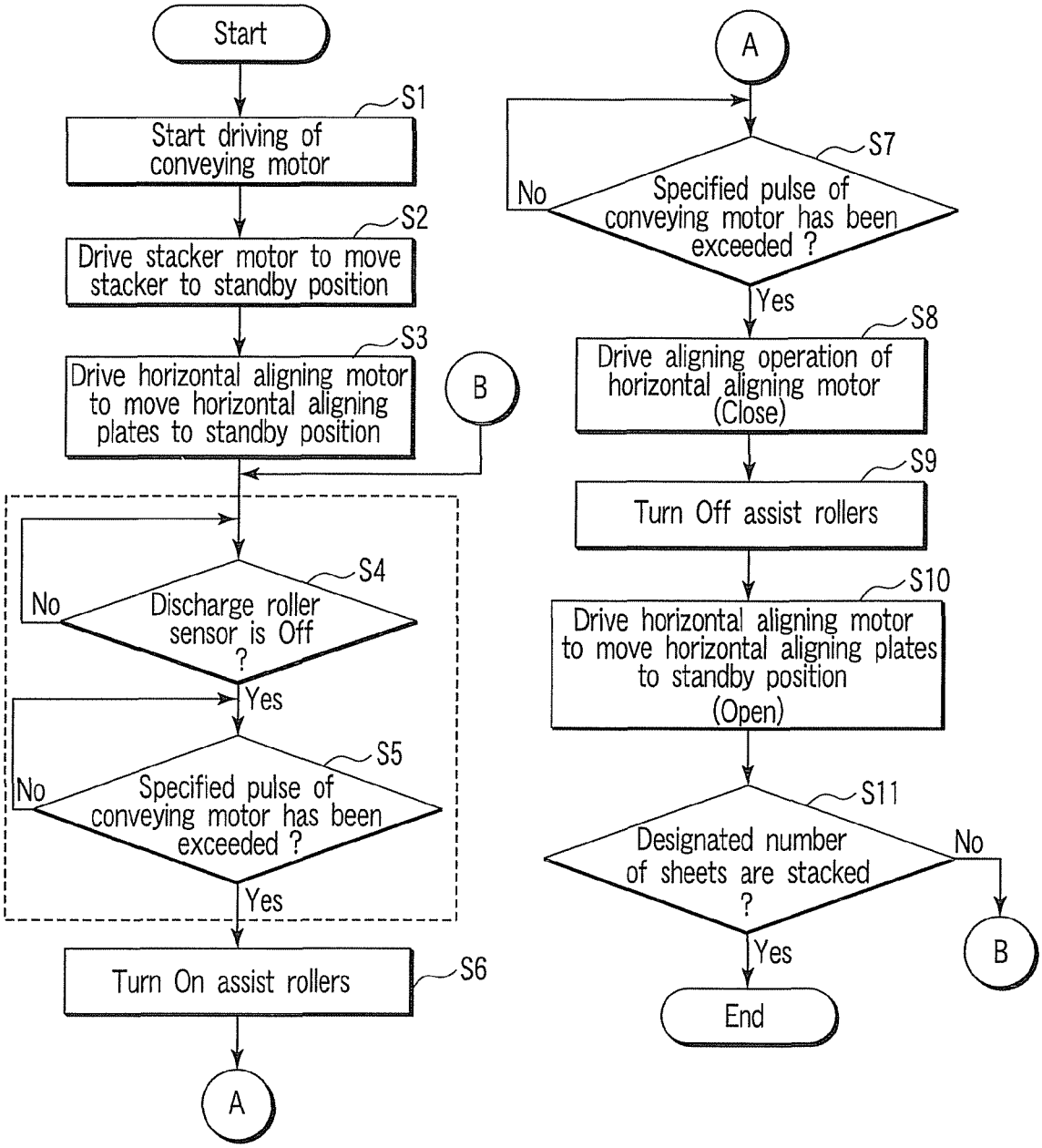
FIG. 10 is a flowchart for explaining operations of a center folding mechanism according to the embodiment.
Figure 11:
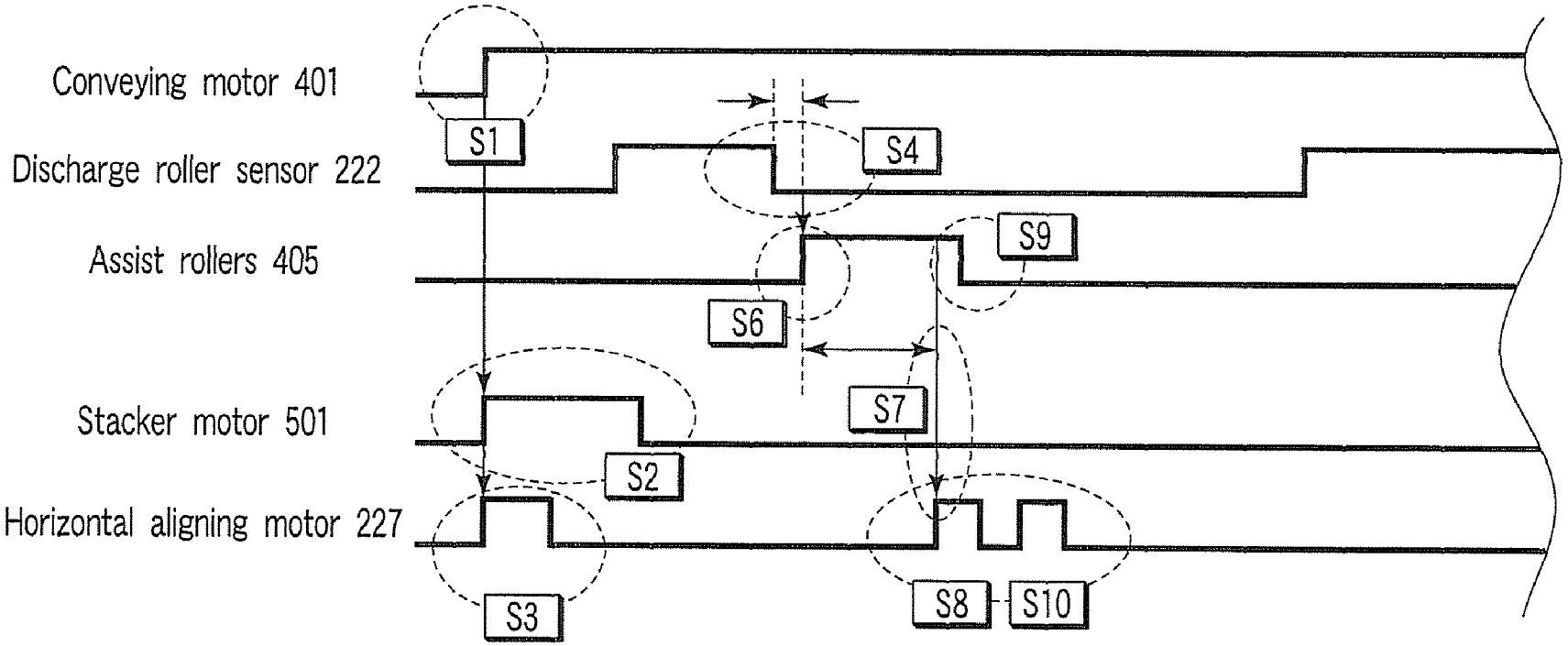
FIG. 11 is a timing chart for explaining operations of the center folding mechanism according to the embodiment.

FIG. 10 is a flowchart for explaining stacking and storage of sheets on the stack tray 218. FIG. 11 is a timing chart for explaining operations of the respective motors in stacking and storing sheets on the stack tray 218. Signs (e.g., S1) shown in FIG. 11 correspond to signs shown in FIG. 10.

When a center binding mode is set for sheets to be discharged from the MFP 10 and a discharge signal for a first sheet by a center folding operation is outputted, the conveying motor 401 starts to be driven (step S1). The stacker 219 and the horizontal aligning plates 230*a* and 230*b* move to standby positions (step S2 and step S3).

Thereafter, the discharge roller sensor 222 is turned on when detection of sheets is started and continues the detection until the discharge roller sensor 222 is turned off when the sheets completely pass and are not detected (step S4). When the discharge roller sensor 222 is turned off, the conveying motor 401 is driven with a specified pulse in order to convey the sheets to the stack tray 218 (step S5).

Subsequently, the assist roller solenoid 407 is turned on (step S6). When the assist roller solenoid 407 is turned on, the assist roller 405 conveys the sheets, which are conveyed to the stack tray 218, to the stacker 219. When the assist roller solenoid 422 is turned on, the conveying motor 401 is driven with a predetermined pulse (step S7). The horizontal aligning motor 227 starts to be driven and performs a horizontal aligning operation for the sheets (step S8).

When the conveying motor 401 is further driven with the predetermined pulse from the start of driving of the horizontal aligning motor 227, the assist roller solenoid 407 is turned off and a rotating operation of the assist roller 405 is turned off (step S9).

Thereafter, when the horizontal aligning operation is finished, the horizontal aligning motor 227 is rotated and driven to move the horizontal aligning plates 230*a* and 230*b* in an opening direction, which is opposite to a direction for the horizontal aligning operation, to the standby position (step S10).

When sheets of the number designated in the MFP 10 are stacked on the stack tray 218, the operation is finished ("YES" in step S11). When sheets of the number designated in the MFP 10 are not stacked on the stack tray 218, the processing returns to step S4 and the detection operation is continued.

After the discharge roller sensor 222 detects a trailing end of a sheet in step S4 and step S5 in FIG. 10, when the sheet being presently processed is a first sheet, the conveying motor 401 reduces conveying speed. This is because, when the sheet being presently conveyed is a first sheet, since sheets are not stacked on the stack tray 218, friction applied to the sheet on the stack tray 218 is small and the sheet excessively jumps upward when the sheet is discharged from the discharge roller 222, which is a last roller on the conveying path A, onto the stack tray 218. Such a problem is prevented by friction of papers if at least one sheet is present on the stack tray 218, for example, in the case of second and subsequent sheets.

The predetermined pulse for turning on the assist roller 405 in steps S6 to S9 in FIG. 10 is different for each of sheet sizes designated in the MFP 10 in the same manner as the standby position of the stacker 219 is different.

Figure 9:
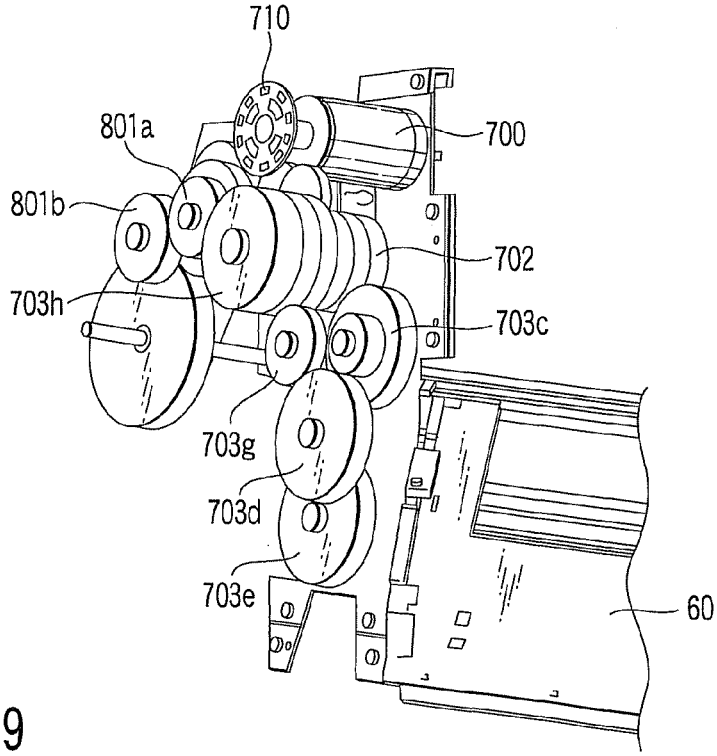
FIG. 9 is a perspective view of the driving mechanism for the folding roller pair according to the embodiment.

The predetermined pulse in step S7 in FIG. 9 is different according to conveying speed for the first, second, or subsequent sheets explained above. This is because, in the horizontal aligning operation by the horizontal aligning plates 230*a* and 230*b*, since the horizontal aligning plates 230*a* and 230*b* need to come into contact with ends along the conveying direction of sheets in a state in which the assist roller 405 is in a standby position, the driving of the horizontal aligning operation indicated by step S8 is finished a predetermined time earlier than step S9 in which the assist roller 405 is turned off.

Operation flows for applying center binding and center folding to a bundle of sheets stacked and stored on the stack tray 218 are explained with reference to FIGS. 12 and 13.

Figure 12:
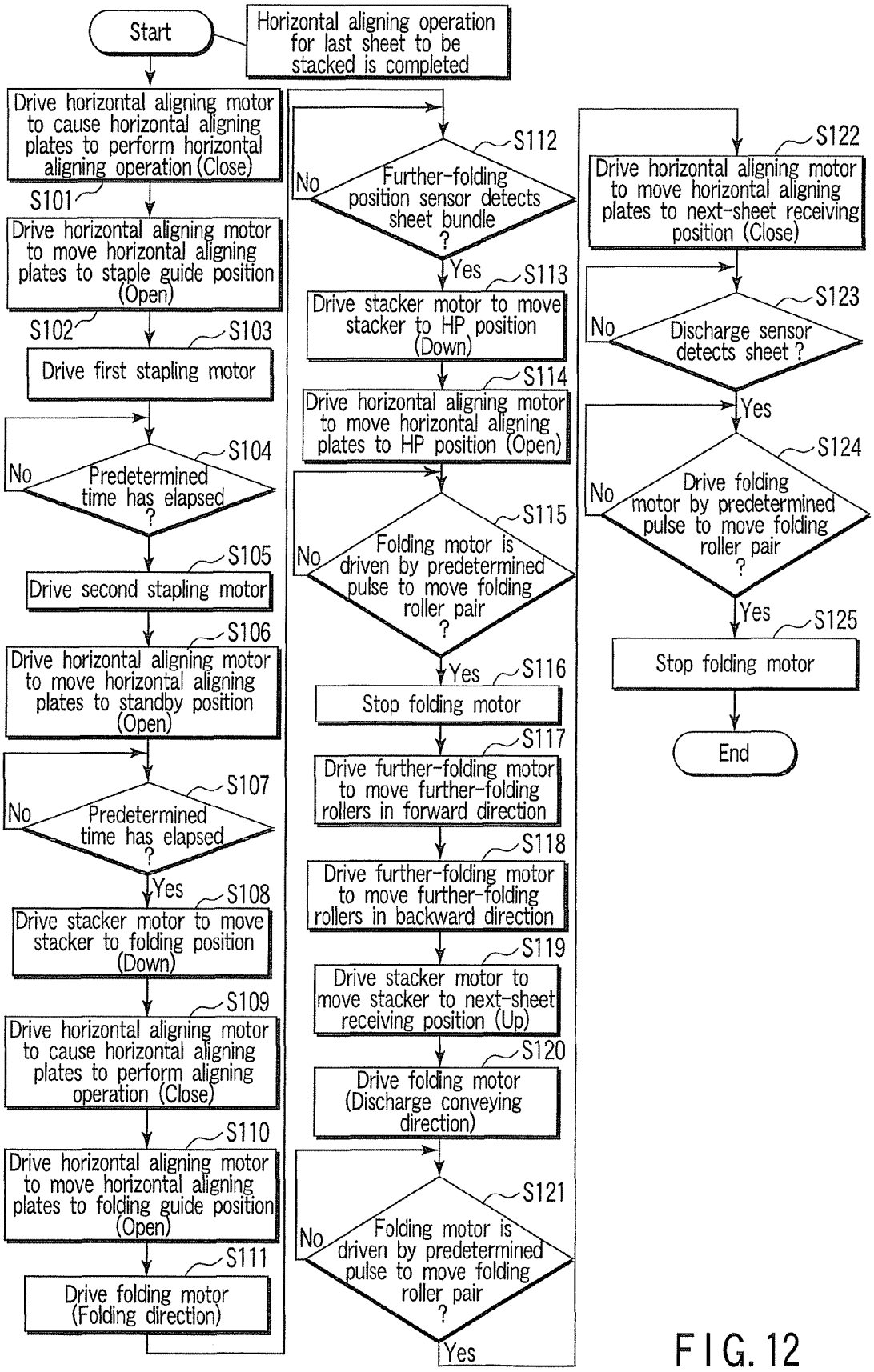
FIG. 12 is a flowchart for explaining operations of the center folding mechanism according to the embodiment.
Figure 13:
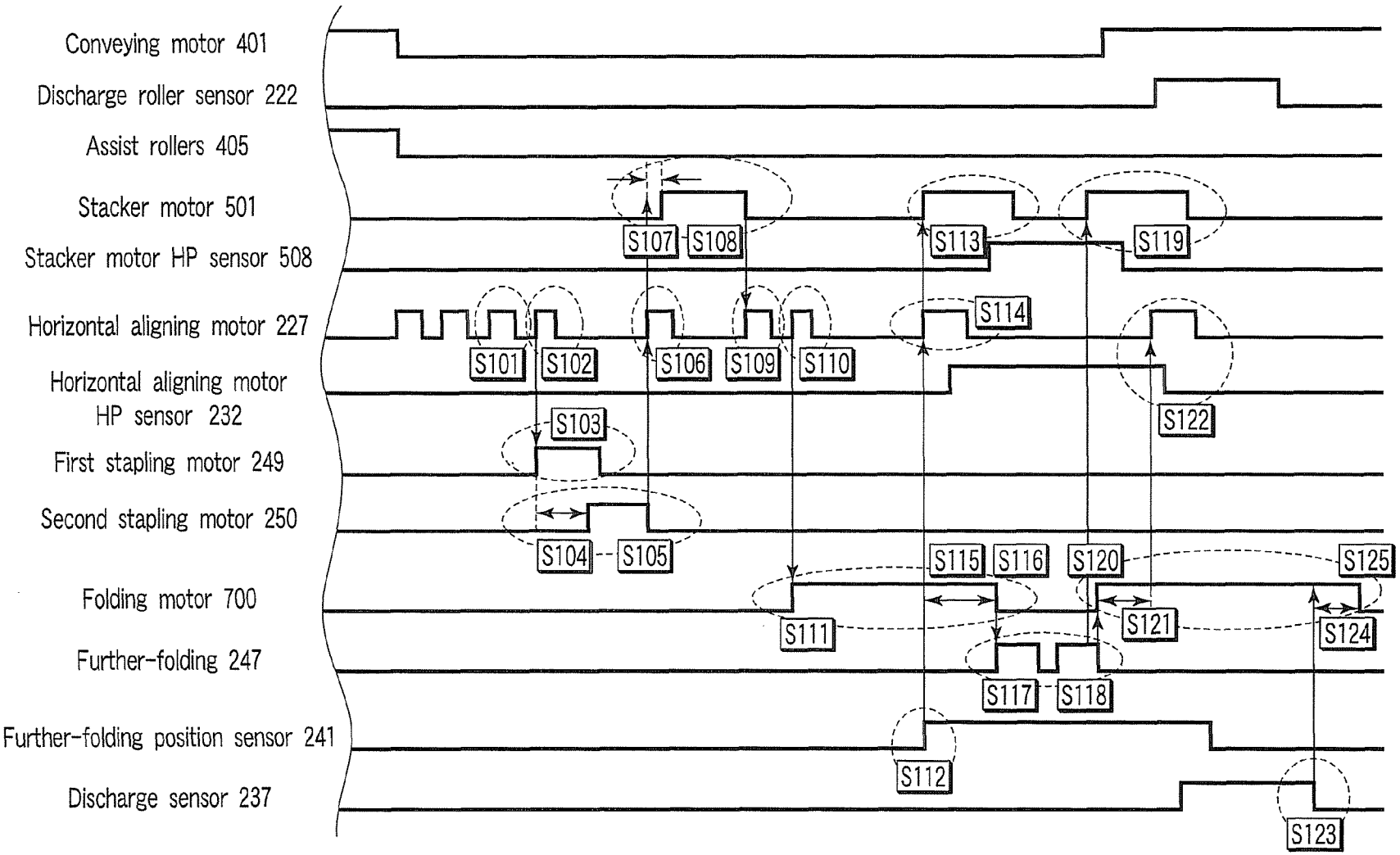
FIG. 13 is a timing chart for explaining operations of the center folding mechanism according to the embodiment.

FIG. 12 is a flowchart for explaining center binding and center folding for a bundle of sheets stacked on the stack tray 218. FIG. 13 is a timing chart for explaining operations of the respective motors in center-binding and center-folding the bundle of sheets stacked on the stack tray 218. Signs (e.g., S101) shown in FIG. 13 correspond to signs shown in FIG. 12.

When the operations in FIGS. 10 and 11 for stacking and storing a bundle of sheets on the stack tray 218 are completed, the horizontal aligning motor 227 is driven in the aligning direction again to cause the horizontal aligning plates 230*a* and 230*b* to perform the horizontal aligning operation for a last sheet to be folded (step S101). The horizontal aligning motor 227 drives the horizontal aligning plates 230*a* and 230*b* in the opening direction to a guide position in performing a stapling operation (step S102).

Simultaneously with the start of the operation of the horizontal aligning motor 227 in step S102, a first stapling motor 249 is driven to cause one stapler 223 of the staplers 223 to perform stapling (step S103).

When a predetermined time elapses after the start of the driving of the first staple motor 249 in step S103 (step S104), a second staple motor 250 is driven to complete the stapling (step S105).

When the stapling by the stapler 223 is completed, the horizontal aligning motor 227 drives the horizontal aligning plates 230*a* and 230*b* in the opening direction to move from a staple guide position to the standby position (step S106).

When a predetermined time elapses from the start of the driving of the horizontal aligning motor 227 in step S106 (step S107), the stacker motor 501 is driven to move the stacker 219 from a stapling position to a folding position and convey the bundle of sheets (step S108).

After the conveying operation is completed for the bundle of sheets, the horizontal aligning motor 227 drives the horizontal aligning plates 230*a* and 230*b* in the aligning direction to perform the horizontal aligning operation again (step S109). Thereafter, the horizontal aligning motor 227 drives the horizontal aligning plates 230*a* and 230*b* in the opening direction to move to the guide position in performing folding again (step S110).

Simultaneously with the start of the driving of the horizontal aligning motor 227 in step S110, the folding motor 700, the folding blade 601, and the electromagnetic clutch 900 are turned on to start a folding operation (step S111).

In the folding operation of the folding motor 700, large torque is necessary and a load applied to the electromagnetic clutch 900 is also large. Therefore, the folding motor 700 may wait for a predetermined time after the electromagnetic clutch 900 is turned on and, then, may start to be driven.

When the folding roller pair 225 folds the bundle of sheets and the folding blade 601 discharges and conveys the bundle of sheets, a further-folding position sensor 241 detects the bundle of sheets (step S112). The further-folding position sensor 241 is arranged in a position where the folding for the bundle of sheets is completed.

When the further-folding position sensor 241 detects the bundle of sheets ("YES" in step S112), the stacker motor 501 and the horizontal aligning motor 227 move the stacker 219 and the horizontal aligning plates 230*a* and 230*b* to home positions (HPs), respectively (steps S113 and S114).

In step S112, the further-folding position sensor 241 determines that the folding roller pair 225 is driven by a predetermined pulse and a leading end of the bundle of sheets has reached a further-folding position ("YES" in step S115). Then, the folding motor 700 stops the driving and the bundle of sheets stops in the further-folding position (S116).

When the bundle of sheets stops in the further-folding position, the further-folding motor 247 is driven to move the further-folding rollers 226 from the HP to a predetermined position (step S117) and performs further folding along a direction from the predetermined position to the HP (step S118).

When another bundle of sheets in the next job setting is continuously conveyed from the MFP 10, while the further-folding rollers 226 are applying the further-folding operation to the bundle of sheets in step S118, the stacker motor 501 is driven to move the stacker 219 to a position where the next bundle of sheets is received (step S119).

When the further-folding for the bundle of sheets by the further-folding rollers 226 is completed, the folding motor 700 is driven and the folding roller pair 225 and the bundle discharge roller pair 236 rotate to start a discharging and conveying operation for the bundle of sheets (step S120).

The folding motor 700 is driven by a predetermined pulse after the start of the driving in step S120 (step S121). When another bundle of sheets in the next job setting is continuously conveyed from the MFP 10, the horizontal aligning motor 227 is driven to move, like the stacker 219, the horizontal aligning plates 230*a* and 230*b* to the position where the next bundle of sheets is received (step S122).

The bundle of sheets is discharged and conveyed by the folding roller pair 225 and the bundle discharge roller pair 225 and a discharge sensor 237 provided downstream the folding roller 225 does not detect the bundle of sheets ("YES" in step S123). Then, the folding motor 700 is driven by a predetermine pulse (step S124) and stops (S125). The bundle of sheets is discharged to and stacked on a paper discharge stack 238 and the job is completed.

When another bundle of sheets in the next job setting is continuously conveyed from the MFP 10, the processing is continued from step S4 in FIG. 11. When another bundle of sheets in the next job setting is not continuously conveyed from the MFP 10, the sheet post-processing apparatus 20 finishes the center folding and waits for a stop command from the MFP 10.

An aligning operation on the waiting tray 206 according to the embodiment of the present invention is explained with reference to FIGS. 14 to 18.

FIG. 14 is a perspective view schematically showing the waiting tray 206 and the processing tray 207. For simplification of explanation, the lower aligning rollers 212 and the like provided in the processing tray 207 shown in FIG. 2 are not shown in FIG. 14.

The waiting tray 206 includes the tray parts 206*a* and 206*b* that support a lower surface of sheets in a direction (an arrow W direction in the figure) (this direction is hereinafter referred to as "width direction "W") orthogonal to a sheet conveying direction (an arrow X direction in FIG. 14). The waiting tray 206 is movable in the width direction W. The pair of tray parts 206*a* and 206*b* are connected to the driving motor 248 via, for example, a not-shown rack pinion mechanism and reciprocatingly moved in synchronization with each other between a supporting position for supporting a lower surface in the width direction of sheets fed along a feeding direction and a releasing position for releasing the support.

When the pair of tray parts 206*a* and 206*b* move to an outer side in the width direction (a out direction), the sheets stacked on the waiting tray 206 fall to the processing tray 207.

Since both the waiting tray 206 and the processing tray 207 are inclined downward to a rear end side, when the sheets P fall from the waiting tray 206 to the processing tray 207, the sheets P are urged to move to the rear end side.

Figure 16B:
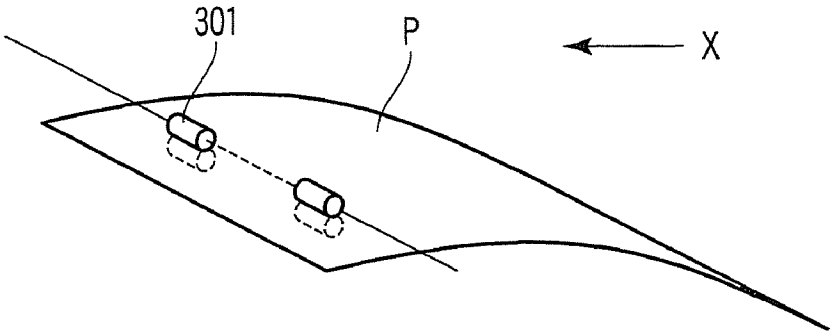
FIGS. 16A and 16B are diagrams showing a change in a sheet due to the stop of press rollers according to the embodiment.
Figure 16A:
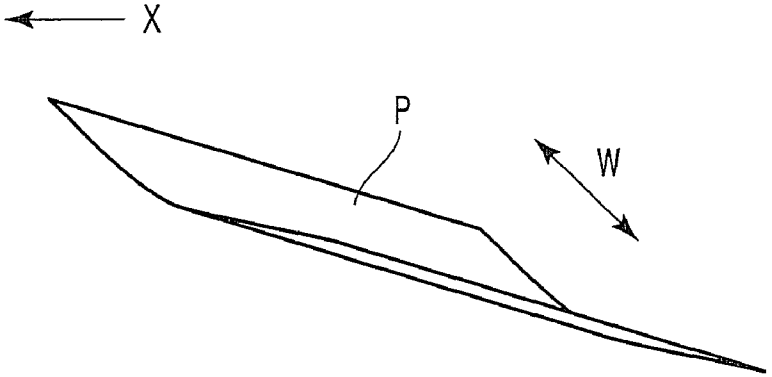

As described above, when a leading end of a first sheet P conveyed via the discharge rollers 204 and put on standby reaches a nip position of the press rollers 301 (see the press rollers 301 indicated by a solid line shown in FIG. 15), the sheet P is conveyed in association with the press rollers 301. As shown in FIG. 14, the waiting tray 206 is a separate body, includes the pair of tray parts 206*a* and 206*b*, and does not support the entire lower surface in the sheet width direction of the sheet P during this conveyance. Therefore, as shown in FIG. 16A, a U-shape (or V-shape) phenomenon in which a portion around the center of the sheet P not supported in the lower surface bends downward may occur. Moreover, depending on sheet length, a frequency of occurrence of the phenomenon is different.

When the leading end of the sheet P is delivered by a predetermined amount from the waiting tray 206 as shown in FIG. 15, the press rollers 301 are temporarily stopped. The leading end of the sheet P hangs down as shown in FIG. 15 because of reaction due to the stop of the press rollers 301 and an own weight of the sheet P and the U-shape phenomenon is eliminated. Even when the press rollers 301 resume the discharge of the sheet P with the leading end thereof hanging down and a trailing end of the sheet P completely passes through the discharge rollers 204 and is discharged to the waiting tray 206, the sheet P bends in an arch shape as shown in FIG. 16B and the trailing end of the sheet P hangs down.

When a second sheet P to be put on standby is conveyed next, since the first sheet P is already stacked on the waiting tray 206, the U-shape phenomenon described above does not occur. When the second sheet P is discharged to and put on standby in the waiting tray 206, to prevent the second sheet P from being conveyed with the first sheet P even if a leading end of the second sheet P reaches the press rollers 301, the nip of the press rollers 301 is opened by switching solenoid 245 (see press rollers 301V indicated by a broken line shown in FIG. 15). The first and second sheets P are nipped by the press rollers 301 at timing when the discharge rollers 204 discharge the trailing end of the sheets to the waiting tray 206 (when a predetermined time elapses after the outlet sensor 205 detects the trailing end of the sheets). In this way, disorder in stacking the sheets is controlled. The sheets that reach the press rollers 301 may be conveyed while a nip position and a retracted (nip opening) position for the leading end of the sheets are repeatedly switched. To prevent the first sheet P and the second sheet P from being conveyed together on the waiting tray 206, chucking means (not shown) for nipping the trailing end of the sheets may be provided in a sheet trailing end receiving section 211*b* on the waiting tray 206 to nip the trailing end of the first sheet P. By switching the conveyance of the first sheet P and the second sheet P to be put on standby as described above, alignment of the trailing ends of the sheets P is not disordered on the waiting tray 206 and improvement of aligning processing accuracy in the processing tray 207 can be realized.

Figure 17:
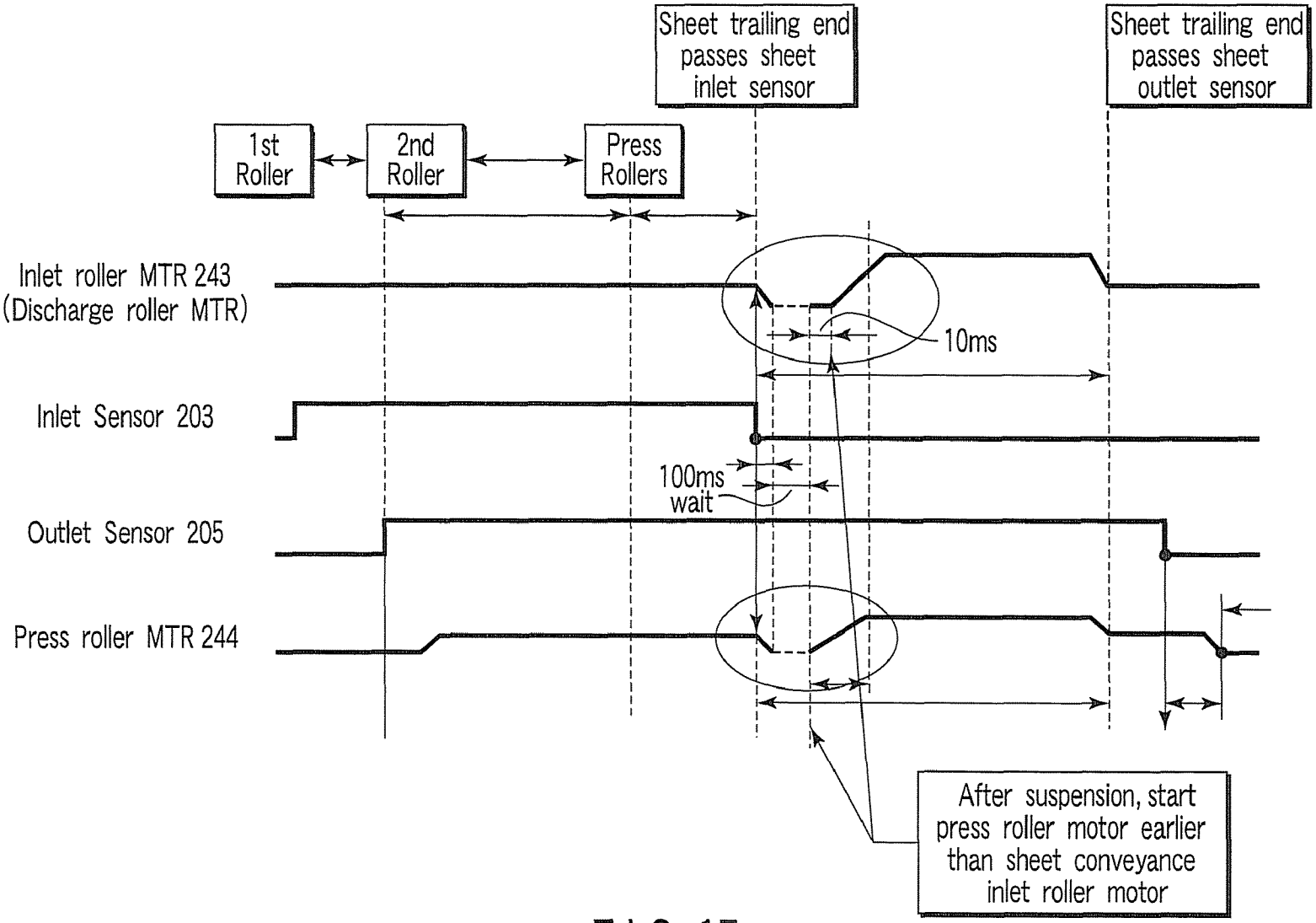
FIG. 17 is a timing chart for explaining timing of driving of press rollers according to an embodiment of the present invention.

A first embodiment of the present invention is explained below with reference to a timing chart for controlling timing for driving the press rollers 301 shown in FIG. 17.

When a first sheet P to be put on standby passes through a nip of the inlet rollers 202 and the inlet sensor 203 detects the passage of (a trailing end) of the sheet P, the inlet roller motor 243 stops being driven and stops driving to rotate the discharge rollers 204 (the first rollers) rotating in associating with the inlet rollers 202. At the same time, the press roller motor 244 stops being driven and stops driving to rotate the press rollers 301 (the second rollers). Consequently, the leading end of the sheet P projecting from the waiting tray 206 bends in an arch shape and hangs down as shown in FIG. 16B. In the timing chart in FIG. 17 according to this embodiment, the inlet roller motor 243 is represented as an inlet roller MTR. However, when the discharge rollers 204 are independently driven, the inlet roller motor 243 only have to be represented as a first roller MTR.

In restart after the suspension, after a predetermined time elapses, the press roller motor 244 starts to be driven and starts driving to rotate the press rollers 301. A little later, the inlet roller motor 243 starts to be driven and starts driving to rotate the inlet rollers 202 and the discharge roller 204. Since the press roller motor 244 and the inlet roller motor 243 are independent from each other, timing for starting driving can be arbitrarily changed. In this case, driving forces of the press roller motor 244 and the inlet roller motor 243 are set larger than those before the driving thereof is stopped, respectively. Therefore, the numbers of revolutions of the inlet rollers 202, the discharge rollers 204, and the press rollers 301 increase, conveyance speed for the sheets also increases. Consequently, although the press roller motor 244 and the inlet roller motor 243 are stopped to cause the leading end of the sheet projecting from the waiting tray 206 to hang down, it is possible to regain conveyance processing time due to time of the stop.

After the first sheet is near the inlet rollers 202 or passes through the inlet rollers 202, the inlet roller motor 243 stops being driven. However, since high-speed conveyance time is provided to regain delay time and a sheet conveyed next from the MFP 10 is processed before being conveyed to the inlet rollers 202, delay in processing for plural sheets conveyed from the MFP 10 is not caused.

Moreover, in restart after the suspension, the press roller motor 244 resumes to be driven (e.g., 10 to 20 ms) earlier than the inlet roller motor 243. Therefore, while the inlet rollers 204 and the discharge rollers 204 are stopped, the press rollers 301 pulls the sheets in the conveying direction. Therefore, the sheet bending between the press rollers 301 and the discharge rollers 204 is stretched. As a result, the leading end of the sheet hanging down from the press rollers 301 tends to further hang down.

It is also possible to distinguish, according to a size of a sheet conveyed from the MFP 10, whether the stop and the resumption of driving of the press roller motor 244 and the inlet roller motor 243 are executed. In other words, if the sheet is a sheet of a size not projecting from the press rollers 301 or an amount of projection of the leading end from the press rollers 301 is within a predetermined amount (e.g., 40% of a dimension in the sheet conveying direction), the U-shape phenomenon of the sheet P shown in FIG. 16A does not occur. For example, when a size of a sheet is twice or more as large as the length along the conveying direction of the waiting tray (e.g., a projection amount of A3 is larger than that of A4), the stop and the resumption of driving of the press roller motor 244 and the inlet roller motor 243 are executed. Then, when plural sheets are continuously conveyed from the MFP 10, processing speed is not reduced. In other words, before the outlet sensor 205 detects the trailing end of the sheet P, the inlet rollers 202 are reset to a normal rotating state (see FIG. 17).

Figure 18:
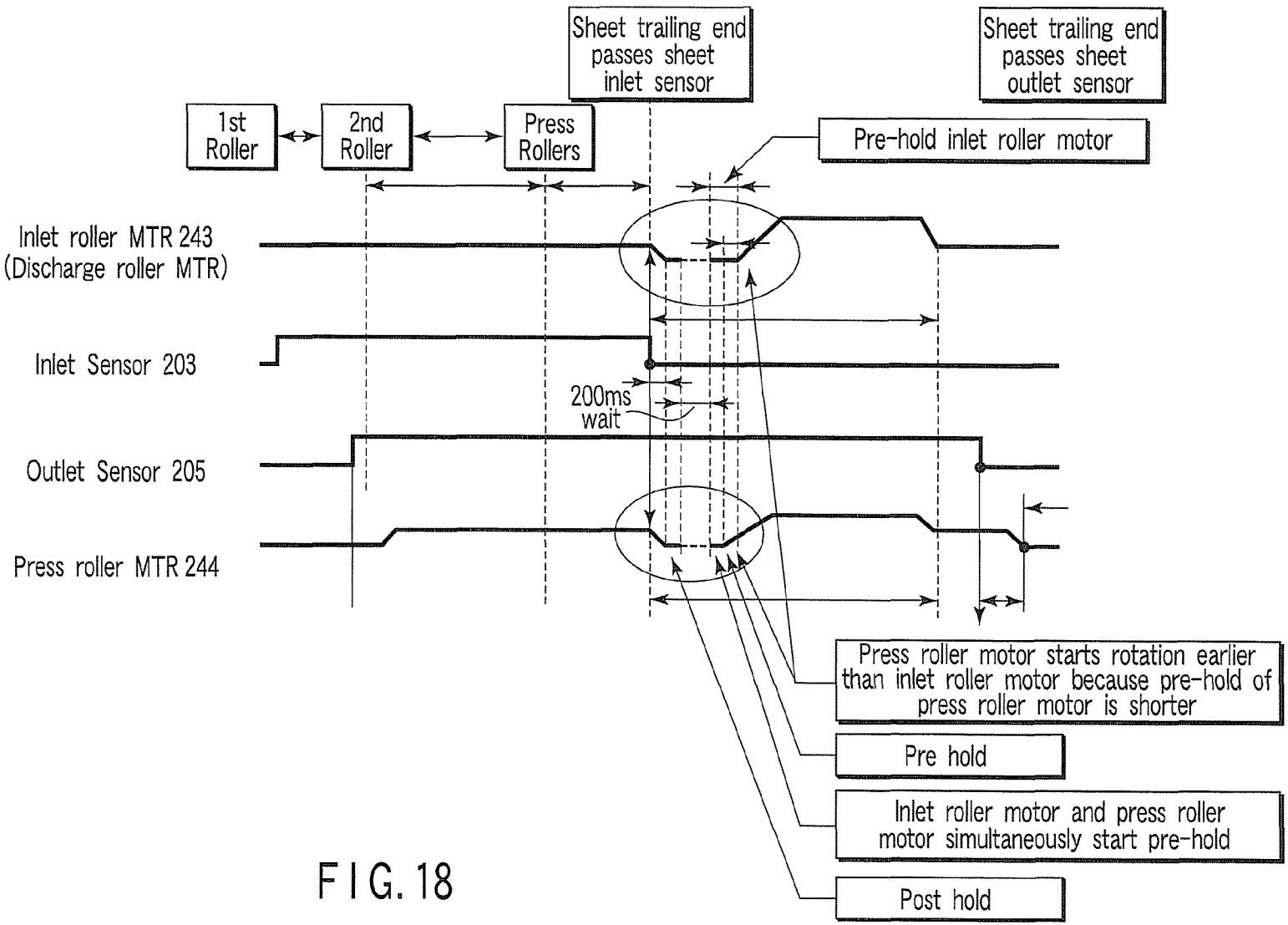
FIG. 18 is a timing chart for explaining timing of driving of press rollers according to another embodiment of the present invention.

A second embodiment of the present invention is explained with reference to a timing chart for controlling timing for driving the press rollers 301 shown in FIG. 18.

As the press roller motor 244 and the inlet roller motor 243 that drive the press rollers 301 and the inlet rollers 202 and discharge rollers 204, respectively, stepping motors are used. The press roller motor 244 and the inlet roller motor 243 are controlled with different pre-hold values.

As described above, when the inlet sensor 203 detects passage of a trailing end of a first sheet to be put on standby, the inlet roller motor 243 stops being driven according to post-hold and stops driving to rotate the inlet rollers 202 and the discharge rollers 204. At the same time, the press roller motor 244 stops being driven according to post-hold and stops driving to rotate the press rollers 301. Consequently, as shown in FIG. 16B, the leading end of the sheet P projecting from the waiting tray 206 hangs down.

In restart after the suspension, when a predetermined time elapses, the press roller motor 244 and the inlet roller motor 243 simultaneously start pre-hold. As shown in FIG. 18, pre-hold of the press roller motor 244 is set shorter than that of the inlet roller motor 243. Therefore, since the press rollers 301 (the second rollers) start to be driven to rotate earlier than the inlet rollers 202 and the discharger rollers 204, the press rollers 301 pull the leading end of the sheet. Therefore, the sheet loosened between the press rollers 301 and the inlet rollers 202 is stretched, tension is given to the sheet, and the U-shape phenomenon of the sheet is eliminated. As a result, as shown in FIG. 16B, the leading end of the sheet P hanging down from the press rollers 301 tends to further hang down.

As indicated by the second embodiment, the rotating roller motor 244 and the inlet roller motor 243 are set to have different pre-hold and post-hold values. Consequently, the press roller motor 244 and the inlet roller motor 243 are controlled more easily than controlling timing for starting driving of the press roller motor 244 and the inlet roller motor 243.

The inlet rollers 202 and the discharge rollers 204 are driven independent from each other as described above and, when the inlet sensor 203 detects a trailing end of a sheet, only the discharge rollers 204 (the first rollers) may be stopped simultaneously with the press rollers 301.

As described above, in the embodiment of the present invention, the discharge rollers 204 (the first rollers) are disposed on an upstream side of the waiting tray 206 and the press rollers 301 (the second rollers) are disposed on a downstream side of the waiting tray 206.

Vertical alignment according to an embodiment of the present invention for sheets dropped onto the processing tray 207 is explained with reference to FIG. 19.

Vertical alignment on the processing tray 207 is performed by striking the trailing end of the sheep P against the trailing end stoppers 213 according to the rotation of the paddle 211 that comes into contact with an upper surface of a sheet located at the top of a bundle of plural sheets stacked on the processing tray 207 and the lower aligning rollers 212 as lower aligning member (e.g., rotating belts or rollers are suitable but, in the following explanation, rollers are used) that come into contact with a lower surface of a sheet located at the bottom of the bundle of the stacked plural sheets.

Plural sheets are conveyed from the MFP 10 for one job setting. Sheets that have passed the outlet sensor 205 through the conveying path A are stacked on the waiting tray 206 via the discharge rollers 204. In this case, when first two sheets are stacked on the waiting tray 206, a bundle of two sheets falls from the waiting tray 206 to the processing tray 207 according to the movement of the pair of tray parts 206*a* and 206*b*. As described above, third and subsequent sheets that have passed the discharge rollers 204 through the conveying path A are conveyed to the processing tray 207 through the waiting tray 206 or not through the waiting tray 206 one by one.

In this case, since the sheets continuously fall to the processing tray 207, positional deviation of the sheets may be caused by collision of the sheets, falling vibration, a conveyance air flow, or the like and disorder in stacking on the processing tray 207 may be caused.

Figure 19:
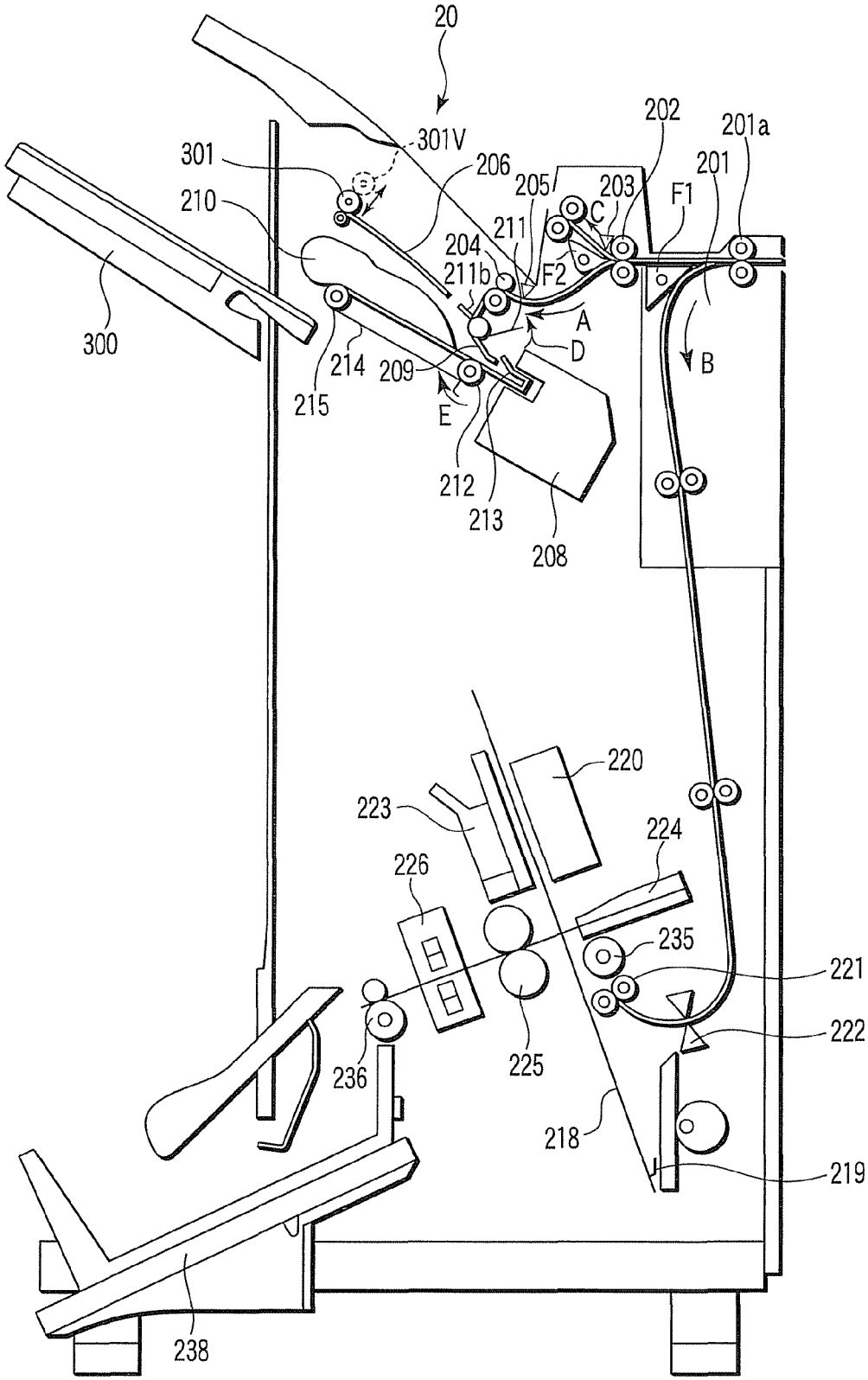
FIG. 19 is a schematic diagram showing a sheet post-processing apparatus according to an embodiment of the present invention.

In this embodiment, when a bundle of first two sheets conveyed from the MFP 10 for one job setting is stacked on the processing tray 207 through the waiting tray 206, the paddle 211 rotates in an arrow D direction shown in FIG. 19 and the lower aligning rollers 212 rotate in an arrow E direction to strike a trailing end of the bundle of two sheets against the trailing end stoppers 213 to vertically align the sheets. Alternatively, as in the sort mode, sheets may be stacked on the processing tray 207 one by one through the waiting tray 206 from the beginning.

One sheet that has passed through the discharge rollers 204 is conveyed through the waiting tray 206 or not through the waiting tray 206 and directly stacked on the bundle of two sheets already stacked on the processing tray 207. In this case, the paddle 211 rotates in the arrow C direction and the lower aligning rollers 212 rotate in the arrow E direction to strike a trailing end of a bundle of three sheets against the trailing end stoppers 213 to vertically align the sheets.

A fourth sheet that has passed through the discharge rollers 204 is conveyed through the waiting tray 206 or not through the waiting tray 206 and directly stacked on the bundle of three sheets already stacked on the processing tray 207. The paddle 211 rotates in the arrow D direction and strikes a trailing end of the bundle of four sheets against the trailing end stoppers 213 to vertically align the sheets. The lower aligning rollers 212 do not rotate in the arrow E direction.

After that, sheets are conveyed through the waiting tray 206 or not through the waiting tray 206 and stacked one by one on a bundle of plural sheets already stacked on the processing tray 207. In this case, only the paddle 211 rotates in the arrow D direction every time each of the sheets is stacked to strike a trailing end of the bundle of stacked plural sheets against the trailing end stoppers 213 to vertically align the sheets.

A last sheet of the number of sheets in job setting is conveyed from the MFP 10 and stacked on a bundle of plural sheets already stacked on the processing tray 207 through the waiting tray 206 or not through the waiting tray 206. Then, the paddle 211 rotates in the arrow C direction and the lower aligning rollers 212 rotate in the arrow E direction to strike a trailing end of a bundle of stacked plural sheets against the trailing end stoppers 213 to vertically align the sheets.

As explained above, the paddle 211 rotates in the arrow D direction every time a sheet is stacked on the processing tray 207 and vertically aligns an upper surface of a sheet located at the top of a bundle of plural sheets stacked on the processing tray 207.

On the other hand, for the number of sheets in one job setting, sheets are stacked on the processing tray 207 in stacking in a first time (when a bundle of first two sheets conveyed from the MFP 10 is stacked on the processing tray 207 via the waiting tray 206), stacking in a second time (when a sheet is stacked on the bundle of two sheets already stacked on the processing tray 207 through the waiting tray 206 or not through the waiting tray 206), and stacking in a last time (a sheet is directly stacked on the bundle of plural sheets already stacked on the processing tray 207 through the waiting tray 206). Then, the lower aligning rollers 212 rotate in the arrow E direction and vertically align a lower surface of a sheet located at the bottom of the bundle of plural sheets stacked on the processing tray 207.

Sheets conveyed from the MFP 10 are finished to be stacked on the processing tray 207 in stacking in a third time (the sheet is directly stacked on a bundle of three sheets already stacked on the processing tray 207 through the waiting tray 206) in one job setting. In this case, every time the sheet is stacked in three times of stacking, the paddle 211 and the lower aligning rollers 212 vertically align a bundle of plural sheets stacked on the processing tray 207.

According to the above description, the lower aligning rollers 212 vertically align the bundle of plural sheets stacked on the processing tray 207 in the stacking in the first time and the stacking in the second time. Therefore, even if the trailing end of the bundle of two sheets stacked in the stacking in the first time cannot be struck against the trailing end stoppers 213, since the lower aligning rollers 212 vertically align the bundle of plural sheets stacked on the processing tray 207 up to the stacking in the second time, the trailing end of the bundle of plural sheets can be surely struck against the stopper 213.

The lower aligning rollers 212 vertically align the bundle of two sheets stacked on the processing tray 207 in the stacking in the first time. Therefore, when the trailing end of the bundle of plural sheets is surely struck against the trailing end stoppers 213, even if disorder occurs in stacking on the processing tray 207 because of falling vibration or the like of the sheets due to the stacking in the second time, the lower aligning rollers 212 vertically align the sheets. Therefore, the trailing end of the bundle of plural sheets can be surely struck against the trailing end stoppers 213.

In this way, the number of times of vertical alignment by the lower aligning rollers 212 is limited. Since the number of stacked sheets is small in the bundle of plural sheets stacked on the processing tray 207 in each of the stacking in the first time and the stacking in the second time, the trailing end of the bundle of plural sheets can be surely struck against the trailing end stoppers 213. Thereafter, vertical alignment by the lower aligning rollers 212 is not applied to a bundle of plural sheets even if a sheet is stacked on the processing tray 207. However, vertical alignment by the lower aligning rollers 212 is applied to a bundle of plural sheets stacked on the processing tray 207 by stacking in the last time. Therefore, a trailing end of a bundle of plural sheets superimposed differently by stacking of sheets can be surely struck against the trailing end stoppers 213.

By limiting the number of times of vertical alignment by the lower alignment rollers 212, deficiencies such as an aligning trace due to vertical alignment of a lower surface of a sheet located at the bottom of a bundle of plural sheets stacked on the processing tray 207 are not left.

In the above explanation, the lower aligning rollers 212 perform vertical alignment three times when the sheets are stacked on the processing tray 207 in the stacking in the first time, the stacking in the second time, and the stacking in the lat time. However, the number of times of vertical alignment is not limited to this as long as the vertical alignment is not performed every time a sheet is stacked on the processing tray 207.

Figure 20:
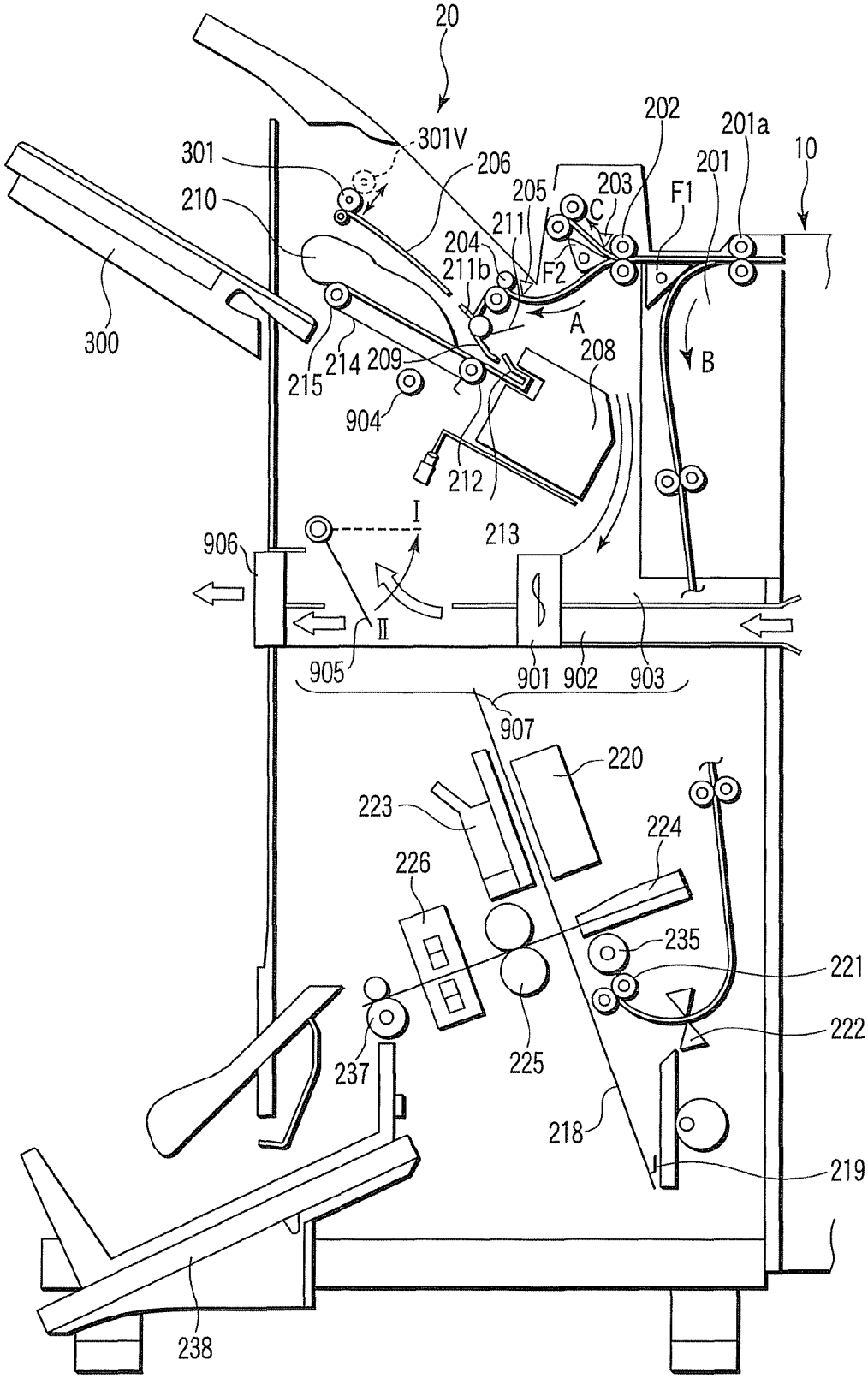
FIG. 20 is a schematic diagram showing the sheet post-processing apparatus according to the embodiment.
Figure 21:
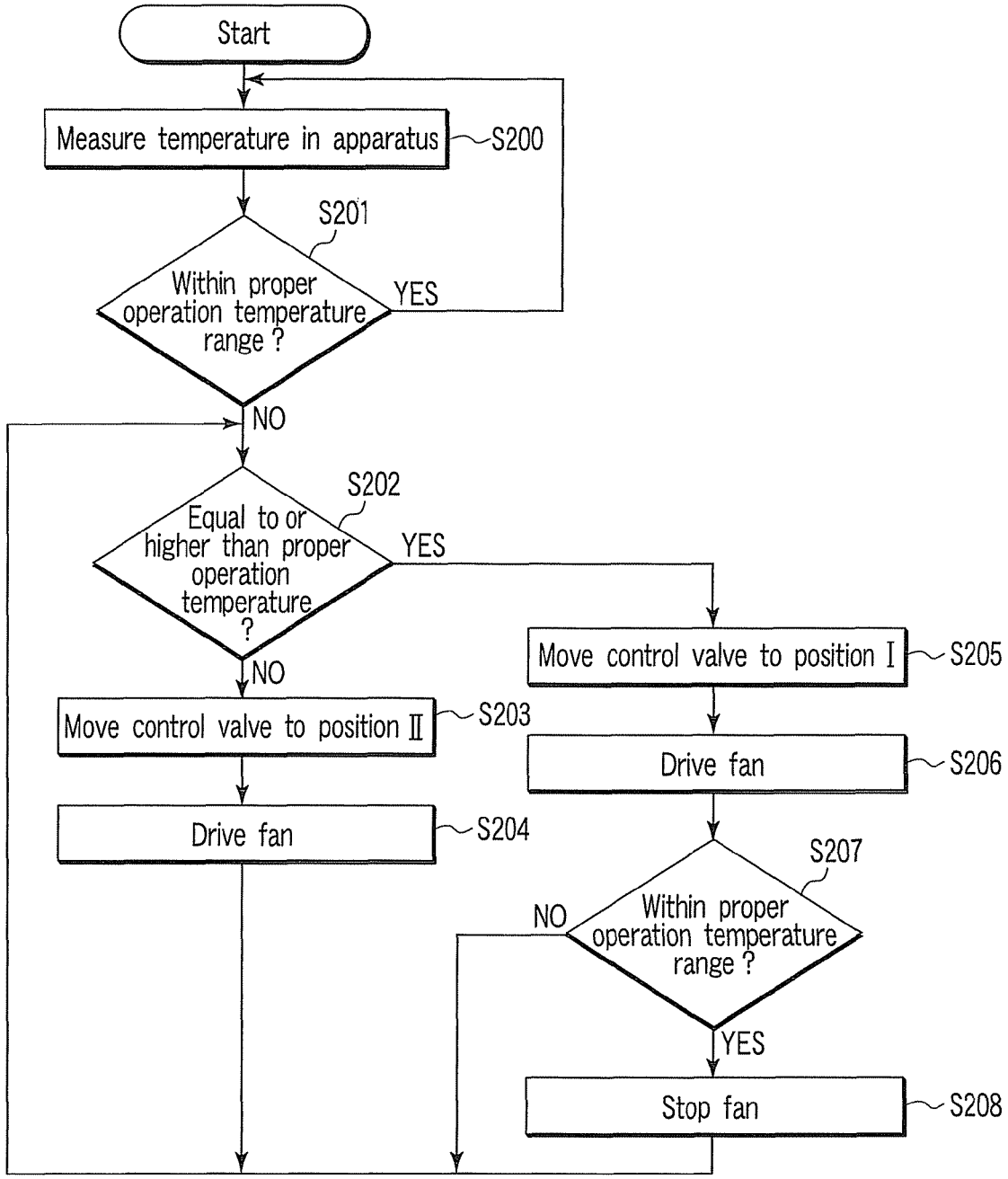
FIG. 21 is a flowchart for explaining temperature adjustment in the sheet post-processing apparatus according to the embodiment.

The structure of a sheet post-processing apparatus including a warming-up device according to an embodiment of the present invention is described in detail with reference to FIG. 20.

A warming-up device 907 included in a sheet post-processing apparatus 20 has a fan 901, a first duct 902, a second duct 903, a temperature sensor 904, a control valve 905, and an exhaust port 906.

The fan 901 is provided at a lower part of the sheet post-processing apparatus 20 and close to the MFP 10 and circulates warm exhaust air sucked through an exhaust opening of the MFP 10. In other words, the fan 901 discharges the sucked warm exhaust air into a housing (not shown) that surrounds mechanical members of the sheet post-processing apparatus 20 such as the temperature sensor 904, the waiting tray 206, the processing tray 207, and the stapler 208.

The first duct 902 is provided to make the MFP 10 and the sheet post-processing apparatus 20 to be spatially continuous. The fan 901 is connected to the first duct 902. Therefore, warm exhaust air caused in the fixing device 104*e* or the like of the MFP 10 is sucked by the fan 901 via the first duct 902. The first duct 902 is arranged in a substantially horizontal direction from the MFP 10 to the sheet post-processing apparatus 20 and to lead the warm exhaust air sucked from the MFP 10 by the fan 901 into the sheet post-processing apparatus 20.

The second duct 903 is arranged downward from an upper part of the sheet post-processing apparatus 20 along a side of the sheet post-processing apparatus 20 on the MFP 10 side. One end of the second duct 903 is connected to the fan 901. The fan 901 sucks the warm exhaust air discharged by the fan 901 to the mechanical members in the housing or the ambient Air in the housing via the second duct 903.

The sheet post-processing apparatus 20 has, on the opposite side of the MFP 10, the exhaust port 906 that is spatially continuous to the outside. The exhaust port 906 is disposed substantially horizontally in a position opposed to the fan 901 along a direction in which the warm exhaust air is discharged.

The temperature sensor 904 is provided a predetermined space apart from the processing tray 207. The temperature sensor 904 is provided in a position where the temperature sensor 904 is not affected by heat of sheets stacked on the processing tray 207 and the temperature in the sheet post-processing apparatus 20 can be measured.

In this case, the sheets stacked on the processing tray 207 are heated by a toner image fixed by the fixing device 104*e*. Therefore, by providing the temperature sensor 904 in the position the predetermined space apart from the processing tray 207 where the temperature sensor 904 is not affected by the heat of the sheets, accurate temperature in the sheet post-processing apparatus 20 can be measured.

The control valve 905 rotates around a shaft. The control valve 905 is provided near the exhaust port 906 and controlled to be switched to a position I (represented by a broken line in FIG. 20) for leading the warm exhaust air discharged by the fan 901 and the ambient Air in the housing to discharge the warm exhaust air to the outside of the sheet post-processing apparatus 20 from the exhaust port 906 and a position II for leading the warm exhaust air and the ambient Air to circulate the warm exhaust air in the inside of the sheet post-processing apparatus 20. The control valve 905 is actuated by a driving motor 908 or a solenoid.

When the sheet post-processing apparatus 20 receives a job setting signal for copying, post-processing, or the like from the MFP 10 connected thereto or when the temperature sensor 904 of the warming-up device 907 measures temperature lower than proper operation temperature during cessation of an operation, the control valve 905 moves to the position II for leading the warm exhaust air discharged by the fan 901 to the mechanical units in the sheet post-processing apparatus 20 such as the waiting tray 206, the processing tray 207, the stapler 208, and the temperature sensor 904. In other words, the warm exhaust air linearly discharged from the fan 901 is not discharged to the outside of the sheet post-processing apparatus 20 because the control valve 905 moving to the position II closes the exhaust port 906 but is discharged to an upper part of the sheet post-processing apparatus 20 by the control valve 905 serving as a wall. At the same time, the fan 901 also sucks and discharges the ambient Air (low temperature Air) in the housing via the duct 903. Therefore, the ambient Air hits the wall of the control valve 905 to be changed to mixed Air (wind) with the warm exhaust air and circulates in the housing.

The proper operation temperature is temperature that allows the respective mechanical unit forming the sheet post-processing apparatus 20 to operate without emitting large noise and discomforting a user, although not being incapable of operating, and without being delayed. In other words, the proper operation temperature is proper operation temperature (20±5° C.) of guaranteed temperature (e.g., 10° C. to 40° C.) during an operation of a product.

When the temperature sensor 904 measures temperature equal to or higher than the proper operation temperature, the control valve 905 moves to the position I for leading the warm exhaust air discharged by the fan 901 to discharge the warm exhaust air to the outside of the sheet post-processing apparatus 20 from the exhaust port 906. In other words, the warm exhaust air sucked and discharged by the fan 901 and the ambient Air (high temperature Air) in the housing are discharged to the outside of the sheet post-processing apparatus 20 from the exhaust port 906 by the control valve 905 moving to the position I without being discharged to the upper part of the sheet post-processing apparatus 20. When the temperature sensor 904 detects temperature in a proper operation temperature range during the discharge from the exhaust port 906, the fan 901 is stopped.

As explained above, the warm exhaust air sucked by the fan 901 and the ambient Air in the housing can be discharged to the upper part in the sheet post-processing apparatus 20 and circulated in the housing or can be discharged to the outside of the sheet post-processing apparatus 20 by the switching of the control valve 905 provided near the exhaust port 906.

The maintenance of the proper operation temperature in the sheet post-processing apparatus 20 by the switching of the position of the control valve 905 and the driving and the stop of the fan 901 explained above is explained with reference to a flowchart shown in FIG. 20. First, the temperature sensor 904 measures temperature in the sheet post-processing apparatus 20 (step S200). The temperature sensor 904 detects temperature outside the proper operation temperature range (step S201). When the temperature is lower than the proper operation temperature range ("NO" in step S202), the control valve 905 moves to the position II (step S203). The warm exhaust air sucked and discharged by the driving of the fan 901 and the ambient Air in the housing sucked via the duct 903 are discharged to the upper part of the sheet post-processing apparatus 20 and circulated in the housing by the control valve 905 (step S204).

When the temperature is equal to or higher than the proper operation temperature ("YES" in step S202), the control valve 905 moves to the position I (step S205). The warm exhaust air sucked and discharged by the driving of the fan 901 and the high temperature Air in the housing are discharged to the outside of the sheet post-processing apparatus 20 from the exhaust port 906 (step S206).

When the temperature is within the proper operation temperature range ("YES" in step S207), the fan 901 stops the driving (step S208). When the temperature is not within the proper operation temperature range ("NO" in step S207), the processing returns to step S202.

When the control valve 905 is in the position II for circulating the warm exhaust air discharged by the fan 901 in the inside of the sheet post-processing apparatus 20, the warm exhaust air is led to sheets stacked on the processing tray 207 as well. Therefore, the fan 901 can suck heat of the sheets as well via the second duct 903. Therefore, the fan 901 can efficiently collect the warm exhaust air and can reduce time for raising the temperature in the sheet post-processing apparatus 20 to the proper operation temperature (e.g., 20±5° C.) while circulating the ambient Air in the housing. Consequently, the temperature in the sheet post-processing apparatus 20 quickly rises close to the proper operation temperature range. Since the respective mechanical units in the sheet post-processing apparatus 20 are warmed, it is possible to control uncomfortable noise in the mechanical units caused when temperature is low and prevent the fall in productivity.

When the temperature sensor 904 measures temperature lower than the proper operation temperature, the stapler 208 can stop stapling for a bundle of sheets stacked on the processing tray 207 or reduce processing speed to be low compared with normal processing speed. Therefore, when the internal temperature of the sheet post-processing apparatus 20 is not in the proper operation temperature range, since time during which sheets stay in the sheet post-processing apparatus 20 is increased, the sheet post-processing apparatus 20 does not immediately operate. It is possible to prevent noise and the fall in productivity and secure stability. In this embodiment, the warming-up device of the sheet post-processing apparatus 20 having the waiting tray 206, which temporarily puts sheets conveyed from the MFP 10 on standby, is described. However, the same effect can be realized in a sheet post-processing apparatus having the structure for directly stacking sheets on the processing tray 207.

Therefore, according to temperature of an environment in which the sheet post-processing apparatus 20 including the warming-up device according to this embodiment is used and temperature in the apparatus, the control valve 905 that switches a discharge direction of warm exhaust air sucked from the image forming apparatus adjacent to the sheet post-processing apparatus is controlled. Consequently, it is possible to secure stability of apparatus operations because the temperature in the sheet post-processing apparatus is kept at the proper operation temperature. Noise at the time of low temperature is reduced.

The stapler 223 as center binding means according to an embodiment of the present invention is explained with reference to FIGS. 22 and 23. As shown in FIG. 22, the center binding stapler 223 includes the hammer 223*a* and the anvil 223*b*. An arrow I indicates a conveying direction of a sheet after completion of center binding.

Figure 23:
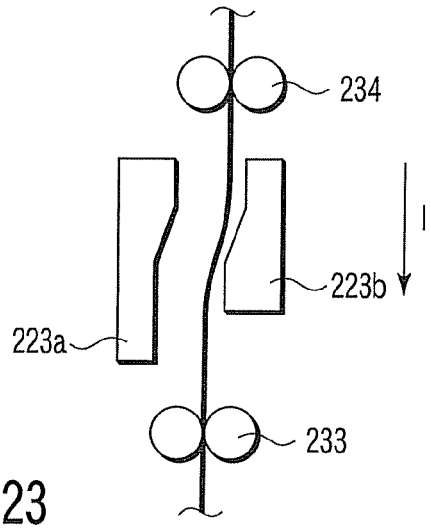
FIG. 23 is a schematic diagram showing a positional relation between the stapler and conveying rollers according to the embodiment.

FIG. 23 shows a positional relation of the hammer 223*a* and the anvil 223*b* and sheets to be subjected to center binding that are conveyed through the conveying path B. The hammer 223*a* and the anvil 223*b* are arranged to be opposed to each other in a thickness direction of the sheet across the sheets. The anvil 223*b* is fixed and the hammer 223*a* moves in a direction orthogonal to a printing surface of the sheets toward the anvil 223*b*. As shown in FIG. 22, the hammer 223*a* drives a staple for center-binding the sheets into the anvil 223*b*. A distal end of the staple driven by the hammer 223*a* is bent by the fixed anvil 223*b* and the center binding for the sheets is completed.

On a downstream side and an upstream side along the conveying direction (the arrow I) of the sheets after stapling with respect to the stapler 223, staple lower conveying rollers 233 (second conveying rollers) and staple upper conveying rollers 234 (first conveying rollers) driven to rotate independently from each other are provided, respectively. The staple lower conveying rollers 233 and the staple upper conveying rollers 234 convey the sheets to a center binding position for center binding by the stapler 223. The staple lower conveying rollers 233 and the staple upper conveying rollers 234 nip and hold the sheets until the stapler 223 completes the center binding for the sheets. When the center binding by the stapler 223 is completed, the staple lower conveying rollers 233 and the staple upper conveying rollers 234 convey the center-bound sheets along the direction of the arrow I to the center folding mechanism unit 60 for center binding the sheets.

In the center binding by the stapler 223, since the staple is driven into the anvil 223*b* by the hammer 223*a*, it is likely that the staple cuts into the anvil 223*b*. However, it was confirmed in a problem solution test that, even if the staple cut into the anvil 223*b* in sheet center binding, the staple cutting into the anvil 223*b* was easily removed by bending the sheets in the conveying direction.

Conveyance of the sheets for solving the problems described above after stapling by the stapler 223 according to the embodiment is explained with reference to FIGS. 24 to 27.

Figure 24:
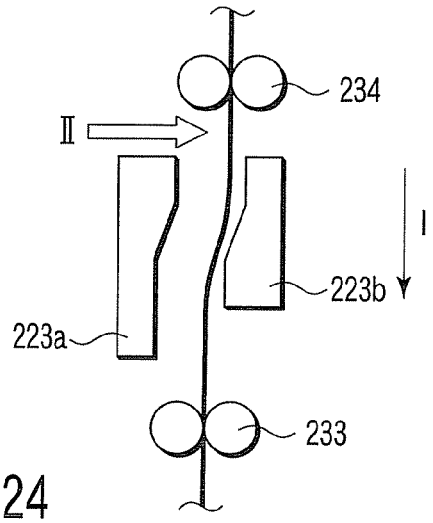
FIG. 24 is a schematic diagram showing operations of the stapler and the conveying rollers according to the embodiment.

First, the staple lower conveying rollers 233 and the staple upper conveying rollers 234 nip and hold a bundle of sheets conveyed through the conveying path B until the center binding by the stapler 223 is completed. As shown in FIG. 24, the hammer 223*a* drives a staple into the bundle of sheets on the anvil 223*b* in a direction of an arrow II.

Figure 25:
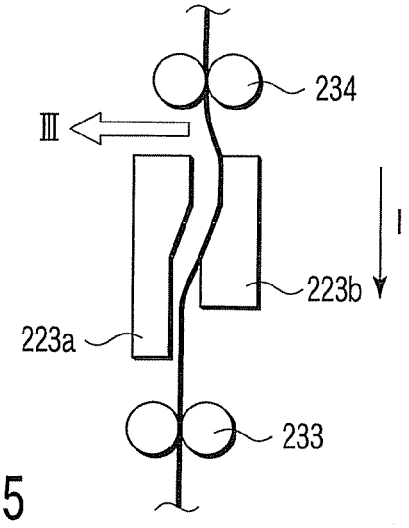
FIG. 25 is a schematic diagram showing operations of the stapler and the conveying rollers according to the embodiment.
Figure 26:
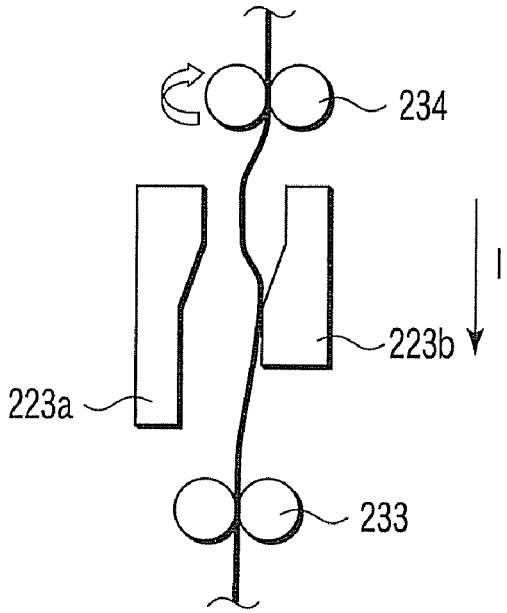
FIG. 26 is a schematic diagram showing operations of the stapler and the conveying rollers according to the embodiment.

As shown in FIG. 25, the hammer 223*a* moves in a direction away from the anvil 223 in a direction of an arrow III. Thereafter, as shown in FIG. 26, the staple upper conveying rollers 234 are driven to rotate to convey the stapled sheets along the direction of the arrow I to the center folding mechanism unit 60 for center-folding the stapled sheets. At this point, since the staple lower conveying rollers 233 are not rotating, the sheets are not conveyed along the direction of the arrow I by the staple lower conveying rollers 233. Since the staple upper conveying rollers 234 are driven to rotate and the staple lower conveying rollers 233 are not driven to rotate as described above, the sheets are conveyed by the stapler upper conveying rollers 234 while being pressed against a nip portion of the staple lower conveying rollers 233 regarded as a fixed end. Therefore, the sheets bend between the staple upper conveying rollers 234 and the staple lower conveying rollers 233 (see FIG. 26).

Figure 27:
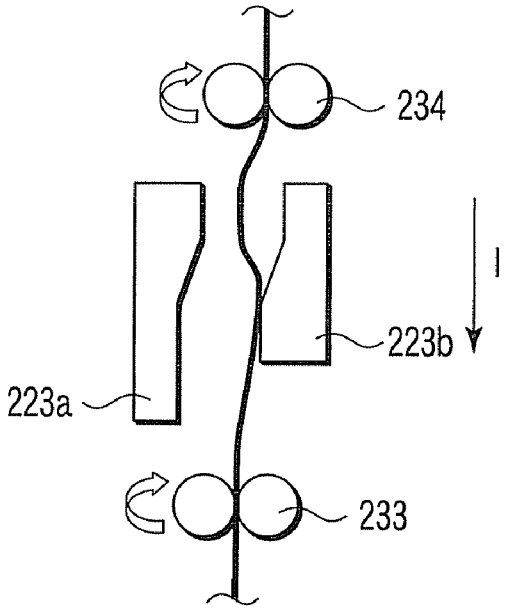
FIG. 27 is a schematic diagram showing operations of the stapler and the conveying rollers according to the embodiment.

Even if the staple cuts into the anvil 223*b* in center binding for a bundle of sheets, it is possible to remove the staple cutting into the anvil 223*b* by slacking off the sheets. In other words, the staple is easily removed from the anvil 223*b*. In a state in which the staple lower conveying rollers 233 stop, after only the staple upper conveying rollers 234 are driven to rotate for a predetermined time×msec (which can be arbitrarily changed), as shown in FIG. 27, both the staple lower conveying rollers 233 and the staple upper conveying rollers 234 are rotated. At this point, when the staple lower sheet conveying rollers 233 start rotation, the staple lower sheet conveying rollers 233 are rotated at rotation speed higher than that of the staple upper conveying rollers 234 by a predetermined time y msec (which can be arbitrarily changed). Thereafter, the staple lower conveying rollers 233 and the staple upper conveying rollers 234 rotate at the same rotation speed.

Therefore, the staple lower conveying rollers 233 and the staple upper conveying rollers 234 can convey the sheets along the arrow I direction after the staple cutting into the anvil 223*b* is removed. The bend of the sheets is quickly eliminated by a difference between the rotation speed of the staple lower sheet conveying rollers 233 and the staple upper conveying rollers 234.

In other words, by bending the sheets with operations of the staple lower conveying rollers 233 and the staple upper conveying rollers 234, the staple cutting into the anvil 223*b* in stapling can be easily removed. Therefore, the staple lower conveying rollers 233 and the staple upper conveying rollers 234 can convey the bundle of sheets without causing a sheet jam.

Figure 28:
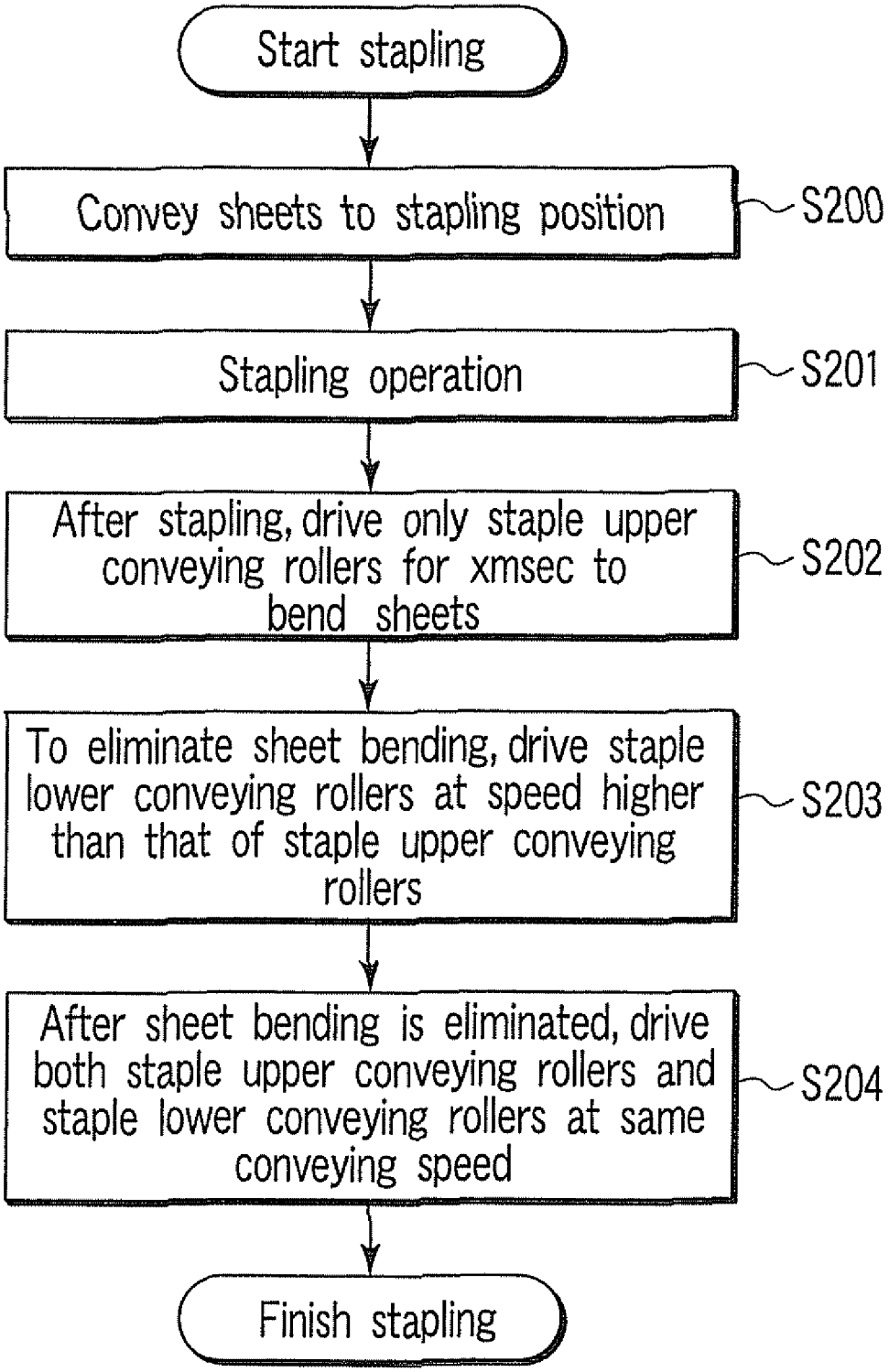
FIG. 28 is a flowchart for explaining operations of the stapler and the conveying rollers according to the embodiment.

The operations of the staple lower conveying rollers 233 and the staple upper conveying rollers 234 are explained with reference to a flowchart shown in FIG. 28.

First, the staple lower conveying rollers 233 and the staple upper conveying rollers 234 convey the sheets to a center binding position and the rotation of the staple lower conveying rollers 233 and the staple upper conveying rollers 234 is stopped (step S200).

The hammer 223*a* and the anvil 223*b* staple the sheets (step S201). When the stapling for the sheets is completed, by driving only the staple upper conveying rollers 234 for the predetermined time×msec while the staple lower conveying rollers 233 are stopped, the sheets bend (step S202). As a result, the staple cutting into the anvil 223*b* is removed.

After only the staple upper conveying rollers 234 are driven for the predetermined time×msec, in order to eliminate the bend of the sheets, when rotation of the staple lower conveying rollers 233 is started, the staple lower conveying rollers 233 are driven at rotation speed higher than that of the staple upper conveying rollers 234 by the predetermined time y msec (step S203).

When the staple lower conveying rollers 233 are driven at the rotation speed higher than that of the staple upper conveying rollers 234 by the predetermined time y msec and the bend of the sheets is eliminated, the staple lower conveying rollers 233 and the staple upper conveying rollers 234 convey the sheets at the same rotation speed (step S204).

The operations of the staple lower conveying rollers 233 and the staple upper conveying rollers 234 are explained with reference to timing charges in FIGS. 29 to 31. These rollers 233 and 234 are driven independently from each other by a driving motor 239 and a driving motor 240 as driving sources for the rollers.

Figure 29:
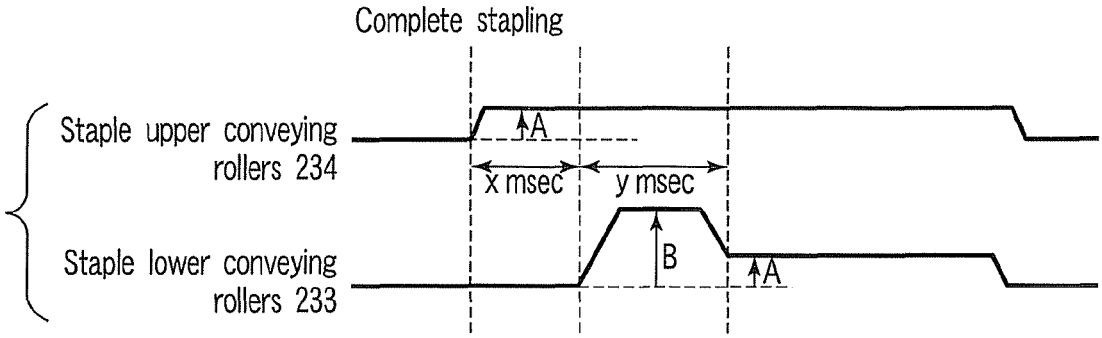
FIG. 29 is a timing chart for explaining operations of the conveying rollers according to the embodiment.

FIG. 29 shows the operations of the staple lower conveying rollers 233 and the staple upper conveying rollers 234 according to the first embodiment for sheet conveyance after stapling.

When the stapling of the sheets is completed by the stapler 223, the staple upper conveying rollers 234 are driven at rotation speed A, which is normal rotation speed, for the predetermined time×msec and the staple lower conveying rollers 233 are kept stopped. Therefore, the sheets bend. Thereafter, the staple upper conveying rollers 234 are continuously driven at the rotation speed A. The staple lower conveying rollers 233 starts to be driven after the predetermined time×msec and is driven at rotation speed B higher than the rotation speed A of the staple upper conveying rollers 234 by the predetermined time y msec. Therefore, the bend of the sheets is eliminated. Therefore, the staple lower conveying rollers 233 rotate at the rotation speed A, which is the normal rotation speed, same as that of the staple upper conveying rollers 234 and convey the sheets.

Figure 30:
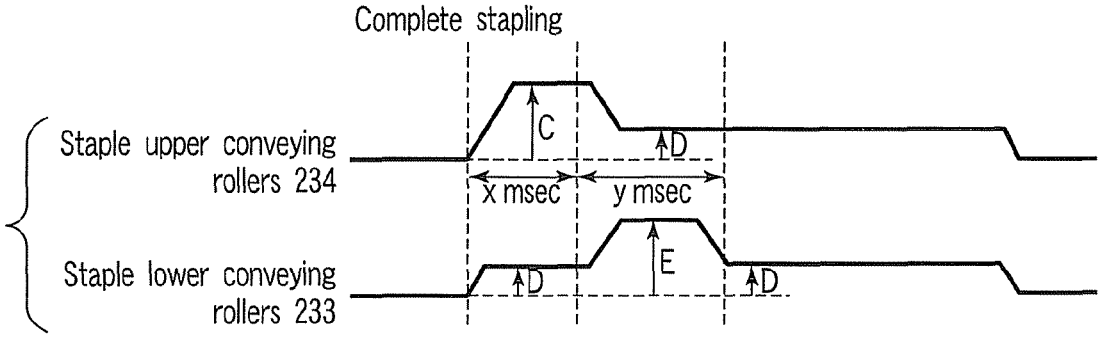
FIG. 30 is a timing chart for explaining operations of conveying rollers according to another embodiment of the present invention.

FIG. 30 shows the operations of the staple lower conveying rollers 233 and the staple upper conveying rollers 234 according to the second embodiment for sheet conveyance after stapling.

When the stapling of the sheets is completed by the stapler 223, the staple upper conveying rollers 234 and the staple lower conveying rollers 233 are simultaneously started to rotate at rotation speed C and rotation speed D, which is normal rotation speed, respectively, and driven for the predetermined time×msec. The rotation speed C of the staple upper conveying rollers 234 is high compared with the rotation speed D of the staple lower conveying rollers 233. Therefore, the sheets bend because of a speed difference between the rotation speed C of the staple upper conveying rollers 234 and the rotation speed D of the staple lower conveying rollers 233. At the same timing immediately after the sheets bend, the staple upper conveying rollers 234 are switched to the rotation speed D, which is the normal rotation speed, lower than the rotation speed C and the staple lower conveying rollers 233 are switched to rotation speed E higher than the rotation speed D, switched to the rotation speed D after the predetermined time y msec, and driven to rotate. The rotation speed E of the staple lower conveying rollers 233 is higher than the rotation speed D of the staple upper conveying rollers 234. Therefore, the bend of the sheets is eliminated. Thereafter, the staple lower conveying rollers 233 rotate at the rotation speed D, which is the normal rotation speed, same as that of the staple upper conveying rollers 234 and convey the sheets in the arrow I direction.

Figure 31:
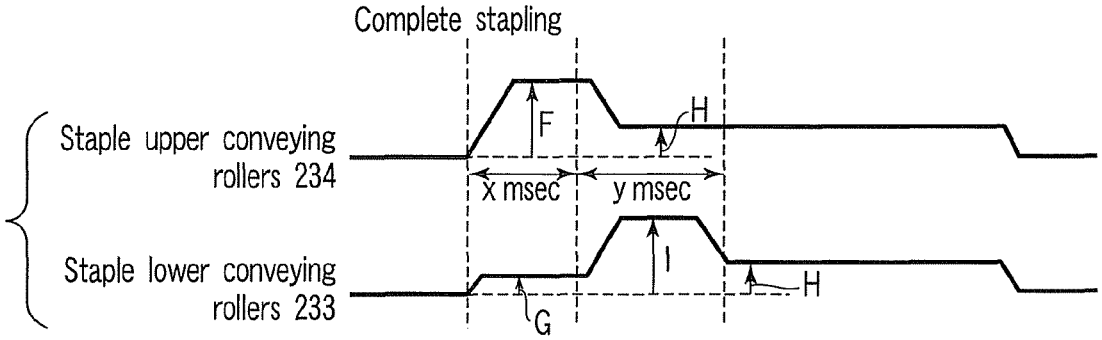
FIG. 31 is a timing chart for explaining operations of conveying rollers according to still another embodiment of the present invention.

FIG. 31 shows operations of the staple lower conveying rollers 233 and the staple upper conveying rollers 234 according to a third embodiment for sheet conveyance after stapling.

When the stapling of the sheets is completed by the stapler 223, the staple upper conveying rollers 234 and the staple lower conveying rollers 233 are simultaneously started to rotate at rotation speed F and rotation speed G, which is lower than normal rotation speed, respectively, and driven for the predetermined time×msec. The rotation speed F of the staple upper conveying rollers 234 is high compared with the rotation speed G of the staple lower conveying rollers 233. Therefore, the sheets bend because of a speed difference between the rotation speed F of the staple upper conveying rollers 234 and the rotation speed G of the staple lower conveying rollers 233.

At the same timing after that, the staple upper conveying rollers 234 are switched to rotation speed H, which is normal rotation speed, lower than the rotation speed F and the staple lower conveying rollers 233 are switched to rotation speed I higher than the rotation speed G and driven for the predetermined time y msec. The rotation speed I of the staple lower conveying rollers 233 is higher than the rotation speed H of the staple upper conveying rollers 234. Therefore, the bend of the sheets is eliminated.

Thereafter, the staple lower conveying rollers 233 rotate at the rotation speed H, which is the normal rotation speed, same as that of the staple upper conveying rollers 234 and convey the sheets.

As explained above, in all the embodiments for sheet conveyance after stapling, when the stapling of the sheets is completed by the stapler 223, the staple upper conveying rollers 234 start to be driven at rotation speed or timing different from that of the staple lower conveying rollers 233. Therefore, a difference occurs in conveying speed of the sheets and the sheets can be bent.

In all the embodiments, the staple lower conveying rollers 233 are started to rotate at rotation speed (including a stopped state) lower than the normal rotation speed. However, since the staple lower conveying rollers 233 are rotated faster than the normal rotation speed after the elapse of the predetermined time×msec in order to eliminate the bend of the sheets, a delay does not occur in conveyance of the sheets for which the stapling is completed and processing speed does not fall. Therefore, it is possible to remove the staple cutting into the anvil 223*b* while improving performance of the sheet post-processing apparatus 20. The processing speed does not fall. Since the staple lower conveying rollers 233 (the second conveying rollers) and the staple upper conveying rollers 234 (the first conveying rollers) are controlled to be driven only by the driving motor 240, cost is low and sheet conveyance after center binding can be performed in a small space.

The center binding by the center binding stapler 223 for a bundle of sheets in the center binding mechanism is explained above as the embodiments of the present invention. However, other than the center binding mechanism, the same effects can be realized by control of rollers provided on a downstream side and an upstream side of a conveying path in any sheet stapling mechanism as long as a stapler includes two members, i.e., a hammer and an anvil, in the sheet stapling mechanism.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet post-processing apparatus comprising:

a stacking tray on which sheets are stacked;

an aligning unit configured to align the sheets stacked on the stacking tray to a reference position;

a staple which staples the sheets aligned by the aligning unit using two members dividedly provided on one surface side and the other surface side in a thickness direction of the sheets;

first conveying rollers arranged in a position for nipping one end of the sheets on an upstream side of the stapler along a conveying direction of the sheets and driven to rotate after the stapling by the stapler; and second conveying rollers arranged in a position for nipping the other end of the stapled sheets on a downstream side of the stapler along a conveying direction of the sheets stapled by the stapler a motor which drives the first conveying rollers and the second conveying rollers at a predetermined rotation speed independently; and a controller which changes a time when the first conveying rollers and the second conveying rollers are driven by the motor, wherein the first conveying rollers are driven to rotate at a rotation speed higher than a rotation speed of the second conveying rollers for a first predetermined time after the stapling by the stapler.

2. A sheet post-processing apparatus according to claim 1, wherein the second conveying rollers are driven to rotate, for a second predetermined time after elapse of the first predetermined time, at rotation speed higher than rotation speed of the first conveying rollers.

3. A sheet post-processing apparatus according to claim 2, wherein the first conveying rollers are driven to rotate, for the second predetermined time, at rotation speed lower than the rotation speed thereof in the first predetermined time.

4. A sheet post-processing apparatus according to claim 3, wherein the first conveying rollers and the second conveying rollers are driven to rotate, after elapse of the second predetermined time, at rotation speed same as the rotation speed of the second conveying rollers in the first predetermined time.

5. A sheet post-processing apparatus according to claim 3, wherein the first conveying rollers and the second conveying rollers are driven to rotate, after elapse of the second predetermined time, at rotation speed higher than the rotation speed of the second conveying rollers in the first predetermined time.

6. A sheet conveying method comprising:

nipping and holding one end side and another end side of sheets with first conveying rollers and second conveying rollers, respectively;

stapling the sheets from a one surface side to another surface side thereof with a stapler arranged between the first conveying rollers and the second conveying rollers; and driving to rotate the first conveying rollers at a rotation speed higher than a rotation speed of the second conveying rollers for a first predetermined time after the stapling wherein the first conveying rollers are arranged on an upstream side of the stapler along a conveying direction of the sheets and second conveying rollers are arranged on a downstream side of the stapler in the conveying direction.

7. A sheet conveying method according to claim 6, further comprising: driving to rotate, for a second predetermined time after elapse of the first predetermined time, the second conveying rollers at rotation speed higher than the rotation speed of the first conveying rollers.

8. A sheet conveying method according to claim 7, further comprising: driving to rotate, for the second predetermined time, the first conveying rollers at rotation speed lower than the rotation speed in the first predetermined time.

9. A sheet conveying method according to claim 8, further comprising: driving to rotate, after elapse of the second predetermined time, the first conveying rollers and the second conveying rollers at rotation speed same as the rotation speed of the second conveying rollers in the first predetermined time.

10. A sheet conveying method according to claim 8, further comprising: driving to rotate, after elapse of the second predetermined time, the first conveying rollers and the second conveying rollers at rotation speed higher than the rotation speed of the second conveying rollers in the first predetermined time.

* * * * *